US012560384B2

(12) United States Patent
Tilghman et al.

(10) Patent No.: US 12,560,384 B2
(45) Date of Patent: Feb. 24, 2026

(54) PLATE-FIN HEAT EXCHANGER

(71) Applicant: BLUE FRONTIER INC., Boca Raton, FL (US)

(72) Inventors: Matthew Tilghman, Pennington, NJ (US); Daniel A. Betts, Parkland, FL (US); Dean Wiersma, Fort Collins, CO (US); Matthew Graham, West Palm Beach, FL (US)

(73) Assignee: BLUE FRONTIER INC., Boca Raton, FL (US)

( * ) Notice: Subject to any disclaimer, the term of this patent is extended or adjusted under 35 U.S.C. 154(b) by 152 days.

(21) Appl. No.: 18/226,985

(22) Filed: Jul. 27, 2023

(65) Prior Publication Data

US 2024/0035750 A1 Feb. 1, 2024

Related U.S. Application Data

(60) Provisional application No. 63/392,752, filed on Jul. 27, 2022.

(51) Int. Cl.
*F28D 1/053* (2006.01)
*F28F 1/12* (2006.01)
*F28F 9/02* (2006.01)

(52) U.S. Cl.
CPC ..... *F28D 1/05341* (2013.01); *F28F 1/128* (2013.01); *F28F 9/0243* (2013.01); *F28F 2215/00* (2013.01); *F28F 2260/02* (2013.01)

(58) Field of Classification Search
CPC ..... F28D 1/05341; F28F 1/128; F28F 9/0243; F28F 2215/00; F28F 2260/02
USPC ..... 165/148
See application file for complete search history.

(56) References Cited

U.S. PATENT DOCUMENTS 6,170,565 B1 * 1/2001 Nishishita ..... F28D 1/0435 165/146
6,209,628 B1 * 4/2001 Sugimoto ..... F28F 1/128 165/146
6,213,196 B1 * 4/2001 Ozaki ..... F28D 1/0435 165/135
6,273,184 B1 * 8/2001 Nishishita ..... F28D 1/05383 165/175
6,308,527 B1 * 10/2001 Kuroyanagi ..... F25B 39/022 62/515
6,308,770 B1 * 10/2001 Shikata ..... F28D 1/0478 165/203
6,357,518 B1 * 3/2002 Sugimoto ..... F28D 1/0435 165/135
6,408,939 B1 * 6/2002 Sugimoto ..... F28F 1/128 165/149
6,938,684 B2 * 9/2005 Iwasaki ..... F28D 1/0408 165/135

(Continued)

*Primary Examiner* — Claire E Rojohn, III
(74) *Attorney, Agent, or Firm* — DUANE MORRIS LLP; Gregory M. Lefkowitz

(57) ABSTRACT

The disclosure relates to plate-fin and manifold assemblies for heat exchangers. In some examples, an assembly includes a first plate and a second plate. The assembly also includes a plurality of fins disposed between the first plate and the second plate. In addition, the plurality of fins are spaced apart by a width large enough adapted for counter-flow of a plurality of fluids between adjacent fins of the plurality of fins. Further, the plurality of fins are configured to direct fluid flow across a length of the first plate and the second plate.

7 Claims, 19 Drawing Sheets

(56) References Cited

U.S. PATENT DOCUMENTS 7,882,708 B2 * 2/2011 Richter ..... F28F 1/128 62/515
7,992,401 B2 * 8/2011 Higashiyama ..... F28D 1/05391 62/515
8,020,524 B2 * 9/2011 Miyagawa ..... F28F 1/126 165/81
8,037,929 B2 * 10/2011 Higashiyama ..... F28F 9/0246 165/172
8,443,873 B2 * 5/2013 Nanaumi ..... B60H 1/00335 165/203
8,627,881 B2 * 1/2014 Alahyari ..... F28F 17/005 165/182
8,707,722 B2 * 4/2014 Kim ..... F28F 17/005 62/286
8,720,529 B2 * 5/2014 Suzuki ..... B60H 1/00328 29/890.03
8,999,255 B2 * 4/2015 Shinoda ..... F02M 35/06 422/186.3
9,000,289 B2 * 4/2015 Vandermeulen ..... F24F 3/1417 136/246
9,101,875 B2 * 8/2015 Vandermeulen ..... F28D 5/00
9,664,450 B2 * 5/2017 Kinder ..... F28D 1/05366
9,689,594 B2 * 6/2017 Johnson ..... F28F 9/02
9,903,658 B2 * 2/2018 Cochran ..... F28D 1/05366
9,939,208 B2 * 4/2018 Sugimura ..... F28D 20/02
9,958,195 B2 * 5/2018 Mazzocco ..... F28D 1/05366
10,126,030 B2 * 11/2018 Kim ..... F25B 47/006
10,323,867 B2 * 6/2019 Vandermeulen ..... F25B 30/04
10,584,921 B2 * 3/2020 Steinbach ..... B21D 53/085
10,739,079 B2 * 8/2020 Lowenstein ..... F28D 5/00
10,905,036 B2 * 1/2021 Jeong ..... H05K 7/20145
11,022,330 B2 * 6/2021 Allen ..... F28D 9/0037
11,092,349 B2 * 8/2021 LePoudre ..... F24F 5/0035
11,098,909 B2 * 8/2021 Vandermeulen ..... F28F 1/02
11,428,478 B2 * 8/2022 Zhou ..... H05K 7/20927
11,629,920 B2 * 4/2023 Cao ..... G01S 17/931 73/866.5
11,779,881 B2 * 10/2023 Yamada ..... B01D 53/28 96/154
11,890,579 B2 * 2/2024 Grinham ..... B01D 67/00415
11,998,871 B2 * 6/2024 Benedict ..... B01D 61/422
12,287,101 B2 * 4/2025 Welch ..... F24D 3/005
2001/0022220 A1 * 9/2001 Ozaki ..... F28D 1/0435 165/135
2004/0226700 A1 * 11/2004 Ko ..... F28F 13/04 165/181
2010/0319370 A1 * 12/2010 Kozubal ..... F24F 3/1417 62/271
2011/0024093 A1 * 2/2011 Shiraichi ..... F28F 1/32 165/181
2012/0024509 A1 * 2/2012 Ueno ..... F28F 17/005 165/173
2012/0180989 A1 * 7/2012 Ota ..... F28D 1/0435 165/104.13
2014/0260398 A1 * 9/2014 Kozubal ..... F25B 15/00 62/271
2014/0366567 A1 * 12/2014 Vandermeulen ..... F25B 15/00 62/271
2015/0233588 A1 * 8/2015 Betts ..... F28D 7/106 62/271
2015/0308711 A1 * 10/2015 Gillan ..... F24H 8/003 122/18.4
2015/0323216 A1 * 11/2015 Wallin ..... F28D 9/0031 165/41
2015/0338140 A1 * 11/2015 Vandermeulen ..... F24F 3/1417 62/238.3
2017/0045257 A1 * 2/2017 Moffitt ..... F28D 21/0015
2019/0113286 A1 * 4/2019 Kunze ..... F28D 21/0015
2021/0278139 A1 * 9/2021 Tarapoom ..... F28F 3/046
2022/0026153 A1 * 1/2022 Bhaskar ..... F24H 4/04
2022/0074679 A1 * 3/2022 Gao ..... F28F 1/128
2023/0130165 A1 * 4/2023 Kamata ..... B01J 19/0013 165/166
2023/0164955 A1 * 5/2023 Chuang ..... F28F 3/06 165/185
2023/0228494 A1 * 7/2023 Martinez ..... F28D 7/0033 165/109.1
2024/0035750 A1 * 2/2024 Tilghman ..... F28F 9/0243
2024/0271882 A1 * 8/2024 Park ..... F28D 1/05391
2024/0381595 A1 * 11/2024 Song ..... H05K 7/20318

* cited by examiner

PLATE-FIN HEAT EXCHANGER

CROSS-REFERENCE TO RELATED APPLICATIONS

This application claims the benefit of priority to U.S. Provisional Patent Application No. 63/392,752, filed on Jul. 27, 2022, the entire disclosure of which is expressly incorporated herein by reference to its entirety.

TECHNICAL FIELD

The disclosure relates generally to heat exchangers and, more particularly, to plate-fin and manifold assemblies for heat exchangers.

BACKGROUND

Heating ventilation and cooling (HVAC) systems generally cool ambient or room temperature air using a vapor compression refrigeration cycle. The HVAC systems may include a heat exchanger that operates to remove heat from a refrigerant. For example, the heat exchanger may include plates or coils through which the refrigerant flows. A fan may blow air across the plates or coils to cool the refrigerant flowing within. Less frequently, the heat exchangers may include a liquid desiccant to dehumidify the air during the cooling process.

SUMMARY

In some embodiments, an assembly includes a first plate and a second plate. The assembly also includes a plurality of fins disposed between the first plate and the second plate. In addition, the plurality of fins are spaced apart by a width large enough adapted for counter-flow of a plurality of fluids between adjacent fins of the plurality of fins. Moreover, the plurality of fins are configured to direct fluid flow across a length of the first plate and the second plate.

In some embodiments, a heat exchanger includes a plurality of fin assemblies, where each fin assembly includes a plurality of fins disposed between a first plate and a second plate. The heat exchanger also includes a first manifold coupled to the plurality of fin assemblies and configured to direct fluid to alternating fin assemblies of the plurality of fin assemblies. In addition, the first manifold includes at least a first fin and a second fin, where a first distance between the first fin and the second fin at a first end is wider than a second distance between the first fin and the second fin at a second end opposite the first end.

In some embodiments, a heat exchanger system includes a heat exchanger, and a first manifold configured to direct fluid to the heat exchanger. Additionally, the first manifold includes at least a first fin and a second fin, where a first distance between the first fin and the second fin at a first end is wider than a second distance between the first fin and the second fin at a second end opposite the first end. The heat exchanger system also includes a second manifold configured to collect at least portions of the fluid from the heat exchanger. The second manifold includes at least a third fin and a fourth fin, where a third distance between the third fin and the fourth fin at a first end is narrower than a second distance between the third fin and the fourth fin at a second end opposite the first end.

In some embodiments, an assembly includes a first plate and a second plate. The assembly also includes a plurality of fins disposed between the first plate and the second plate. In addition, the plurality of fins include at least a first fin, a second fin, and a third fin, where the first fin and the second fin define a first channel, and the second fin and the third fin define a second channel. Moreover, a first distance between the first fin and the second fin at a first end of the first channel is wider than a second distance between the first fin and the second fin at a second end of the first channel opposite the first end of the first channel.

In some embodiments, a method to direct fluids within a heat exchanger includes passing a first fluid in a first direction across a plurality of fins disposed between a first plate and a second plate, where each of the plurality of fins are spaced from at least another of the plurality of fins by a predetermined distance. The method also includes passing a second fluid in a second direction opposite the first direction across the plurality of fins. Further, the method includes passing a third fluid through a plurality of channels of at least one of the first plate and the second plate.

In some embodiments, a method of to divert fluids within a heat exchanger includes passing a first fluid in a first direction substantially through a first portion of a plurality of channels defined by a plurality of manifold assemblies. The method also includes passing a second fluid in a second direction opposite the first direction substantially through a second portion of the plurality of channels defined by the plurality of manifold assemblies.

In some embodiments, a method of to divert fluids within a heat exchanger includes passing a first fluid in a first direction substantially through first channels defined by a plurality of fins. The method also includes passing a second fluid in a second direction opposite the first direction substantially through second channels defined by the plurality fins, where the first channels and the second channels alternate along the plurality of fins.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

Figure 1A:
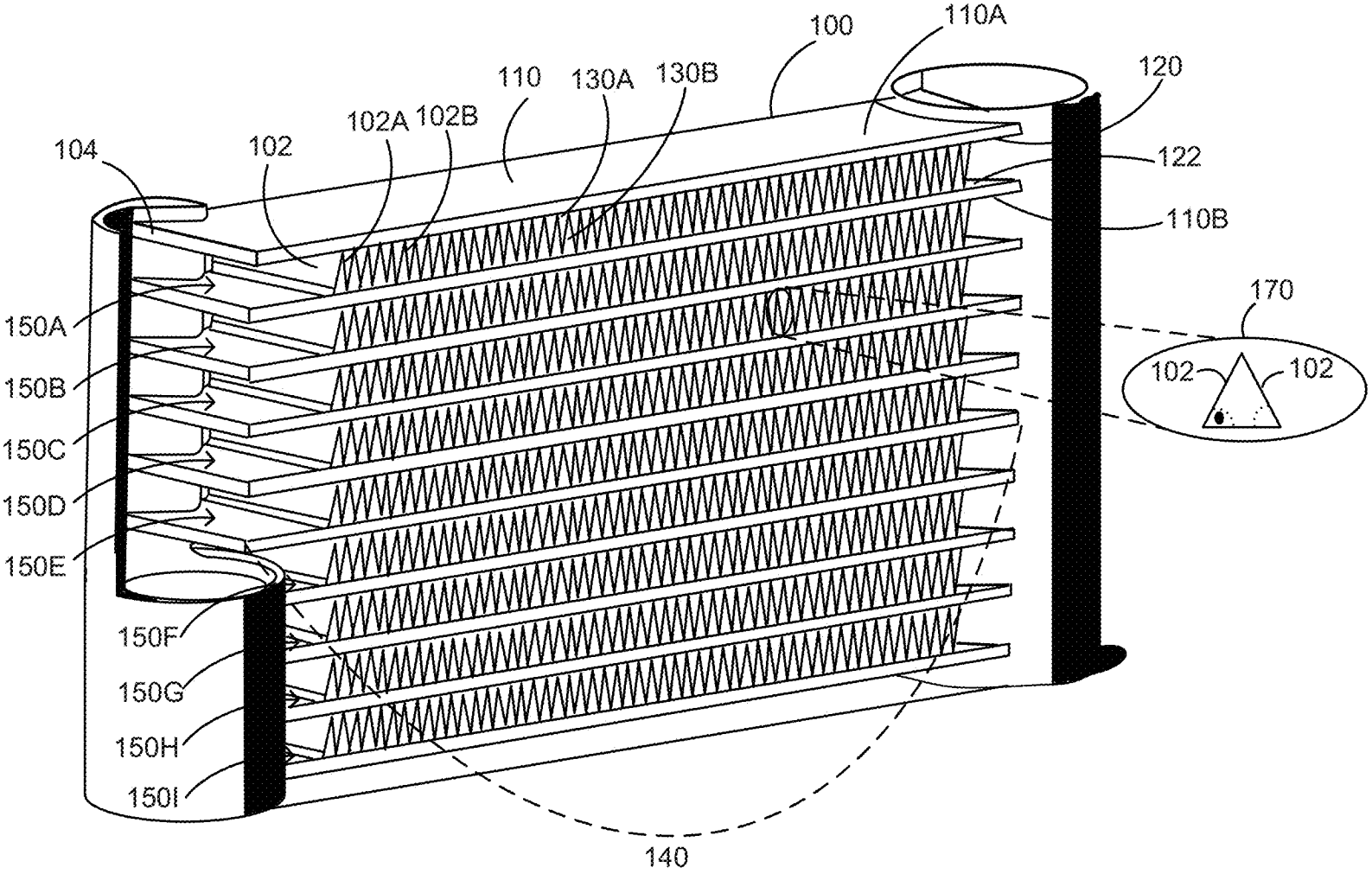
FIG. 1A illustrates a heat exchanger, in accordance with one embodiment.

The following discussion omits or only briefly describes conventional features of heat and mass exchangers that are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest reasonable interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. In the description, relative terms such as "horizontal," "vertical," "up," "down," "top," and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "above" versus "below," "inwardly" versus "outwardly," "longitudinal" versus "lateral," and the like are to be interpreted relative to one another or relative to an axis of elongation, or an axis or center of rotation, as appropriate. Terms concerning attachments, coupling, and the like, such as "connected" and "interconnected," refer to a relationship wherein structures are secured or attached to one another either directly or indirectly through intervening structures, as well as both movable or rigid attachments or relationships, unless expressly described otherwise. The terms "operatively connected," "operably connected," and the like are such attachments, couplings, or connections that allow the pertinent structures to operate as intended by virtue of that relationship.

Embodiments of the present disclosure relate generally to heat exchangers and, more particularly, to plate-fin heat exchangers that facilitate the flow of multiple fluids to transfer heat from a fluid, such as water or refrigerant. The multiple flow of multiple fluids may include flows in different phases. For instance, one flow may be in gas form (e.g., air flow), and another flow may be in liquid form (e.g., water flow), with both flows participating in the heat transfer process. For instance, the two flows (e.g., external flows) may operate to remove heat from a third flow (e.g., an internal flow), such as water or refrigerant. In some examples the flows may mix, at least partially, before or after traversing through a plate-fin heat exchanger.

In some examples, embodiments may include a plurality of fins that are spaced apart at predetermined lengths to encourage liquid flow. The fins may be coupled between two plates, such as two metal plates. In some examples, the fins may also be made of metal. In other examples, the fins may be made of plastic, or any other suitable material. In some instances, the plates include one or more micro-channels that allow for the flow of a fluid, such as a refrigerant. In some examples, the plurality of fins are angled such as to encourage liquid to flow across a first portion of the fins while encouraging gas to flow through a second portion of the fins. In yet other examples, one or more manifolds are coupled to a plate-fin heat exchanger with parallel fins to divert a plurality of flows. For each of these embodiments, a liquid flow, such as a water flow, may be in a direction opposite a gas flow, such as an air flow. As such, both flows may participate in heat transfer while reducing the ability of one flow, such as the liquid flow, to impede the other flow, such as the air flow.

Referring to the drawings, FIG. 1A illustrates an example heat exchanger 100. Heat exchanger 100 may also be referred to as a plate-fin heat exchanger. In one or more cases, heat exchanger 100 facilitates at least two external fluid flows, with both flows participating in the heat transfer process. The two external fluid flows may be of different phases. For instance, a first external flow may be liquid desiccant, and the second external flow may be an air stream. In some examples, heat exchanger 100 may operate as a heat exchanger within, for example, an air condition, a regenerator, or any other suitable system requiring heat transfer.

Heat exchanger 100 may include a plurality of fins 102 disposed between a pair of respective plates 110. For instance, each fin 102 may be coupled to a bottom surface 120 of a respective top plate 110A, and to a top surface 122 of a respective bottom plate 110B. In some examples, the fins 102 and the plates 110 may be manufactured from metal or another material that is thermally conductive. Plates 110 may further include a plurality of micro-channels 104 through which a fluid, such as a refrigerant or water, may flow. Heat exchanger 100 may include multiple rows of fins 102, such as fin rows 150A, 150B, 150C, 150D, 150E, 150F, 150G, 150H, 150I, each row of fins coupled between plates 110. In this example each fin 102 is angled toward another fin 102 at an angle, as shown by magnified illustration 170. In some examples, each fin 102 is tilted to a neighboring fin 102 at an alternating angle anywhere from twenty degrees to 80 degrees, such as at forty-five degrees in a saw-tooth pattern when looking from the front or the back of the heat exchanger. Although in this example each fin 102 is angled toward another fin 102 at an alternating angle relative to the top plate 110A and the bottom plate 110B, in other examples each fin 102 may be generally perpendicular to the plates 110 (i.e., the fin's 102 angle with respect to a plate 110 is approximately ninety degrees). As used herein, generally perpendicular relates to a flow that across the entire length (a straight line from each end of the channel within the plate or across the plate) of the respective channels is perpendicular or deviates from perpendicular by less than 10 degrees.

The plates 110 and the fins 102 may define a plurality of fluid channels 130A, 130B through which one or more of the fluids may flow. The cooling of the air may cause the condensation of water, which then may also flow through the plurality of channels 130A, 130B. In some examples, a second fluid, e.g., liquid desiccant, is provided to the fins 102, and may flow thorough fluid channels 130A, 130B. In some embodiments, the first fluid flows through some of the fin rows (e.g., 150A, 150C, 150E, 150G, etc.) and the second fluid flows through other fin rows (e.g., 150B, 150D, 150F, 150H, etc.). Thus, the first fluid and the second fluid can alternate between adjacent fin rows. In some embodiments, the first fluid flows into a front of the heat exchanger, while the second fluid flow into the back of the heat exchanged in a counter-current arrangement. In some embodiments, the micro-channels 104 direct fluid across the heat exchanger 100. In such an arrangement, fluid flowing through the micro-channels 104 arranged generally perpendicular to the direction of flow of through the rows of fins 150A, 150B, etc.

Further, the fins 102 may be positioned between the plates 110 such that each fin 102 is spaced apart from a neighboring fin 102 by a predetermined distance. In some examples, the fins 102 are spaced to allow for significant liquid flow, such as significant water flow. For instance, the heat exchanger 100 may include a number of fins 102 per a unit of distance. In some examples, heat exchanger 100 includes a number of fins 102 per inch of a length 140 of each plate 110. For instance, heat exchanger 100 may include five fins 102 per inch of the length 140 of each plate 110. In other examples, heat exchanger 100 may include fifteen fins 102 per inch. In some examples, heat exchanger 100 includes anywhere from one to ten, two to six, seven to ten, or one to thirty fins per inch of the length of each plate 110. In some embodiments, the fins 102 are spaced to an extent that allows for liquid flow through the channels without plugging the channels 130A, 130B (e.g., due to surface tension of the liquid). For instance, in some examples, the fins 102 are spaced apart by a width large enough adapted for (e.g., to enable) counter-flow of a plurality of fluids between adjacent fins of the fins 102.

Figure 1B:
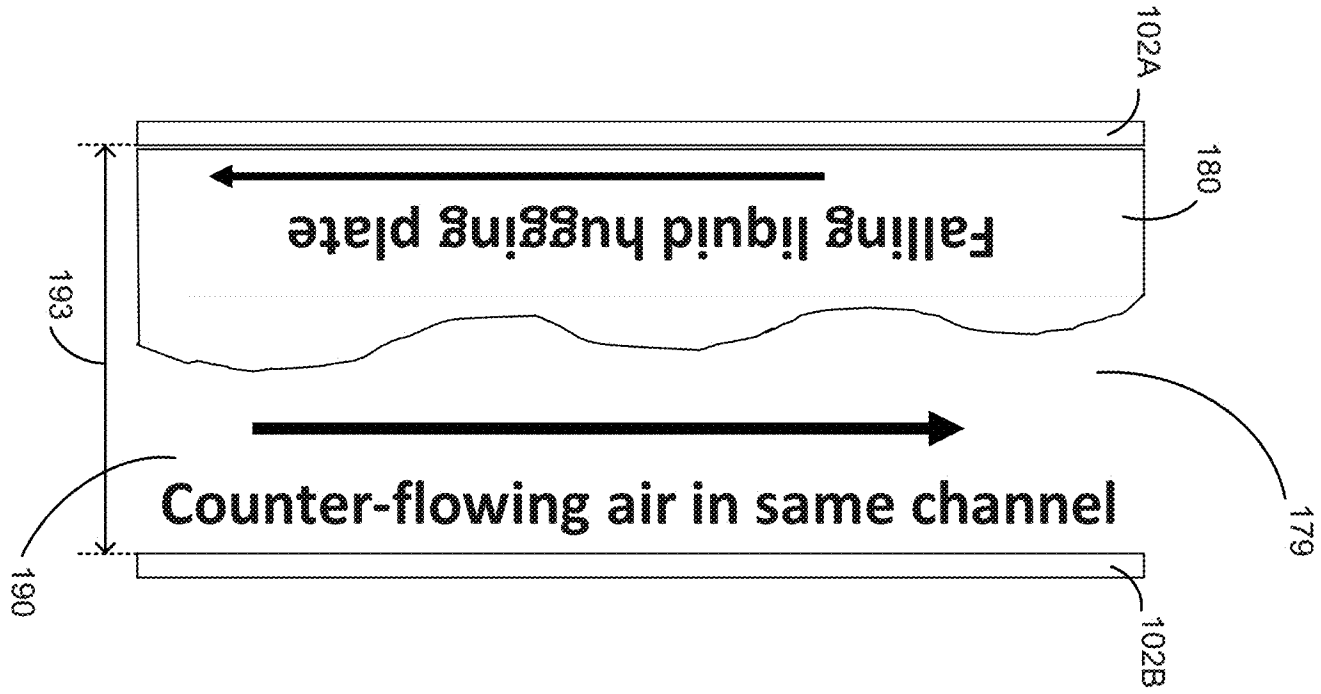
FIG. 1B illustrates flows between fins of the heat exchanger of FIG. 1A.

FIG. 1B, for example, illustrates flow through channels of the heat exchanger of FIG. 1A. As illustrated, both a liquid flow 180 and an air flow 190 proceed through a channel 179 defined by a first fin 102A and a second fin 102B. In this example, the liquid flow 180 proceeds along a face of the fin 102A in a first direction (e.g., downward), while the air flow 190 proceeds through the channel 179 between the liquid flow 180 and the second fin 102B. The fins 102A, 102B are distanced from each other by a predetermined distance large enough that will facilitate both the liquid flow 180 and the air flow 190, as indicated by distance 193.

Figure 10A:
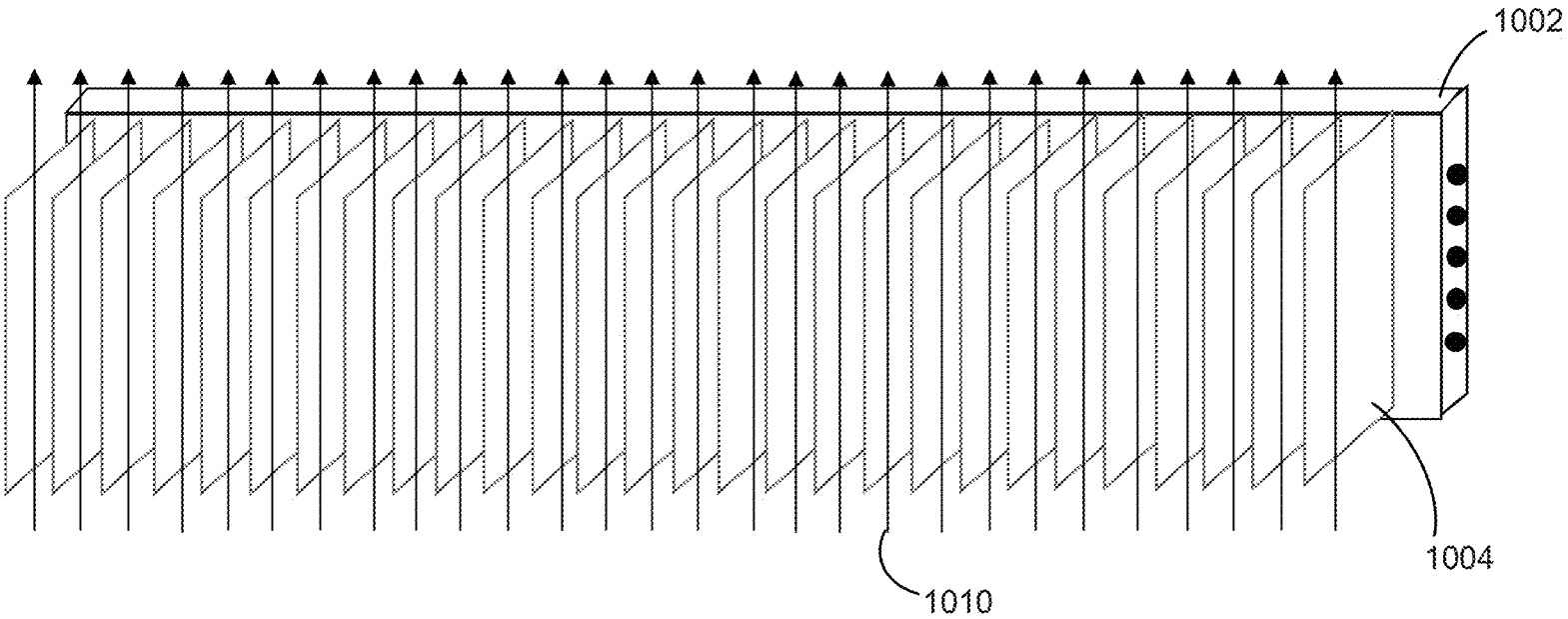
FIG. 10A PRIOR ART
FIGS. 10A and 10B illustrate portions of a prior art heat exchanger.
Figure 10B:
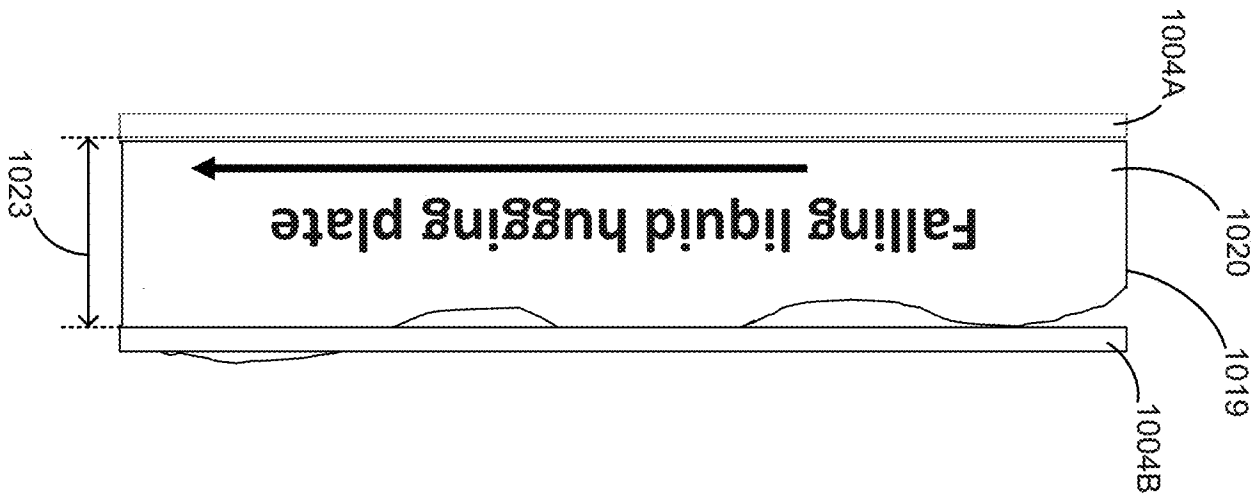
FIG. 10B PRIOR ART

In contrast, FIGS. 10A and 10B illustrate portions of a conventional heat exchanger including a plate 1002 and fins 1004. As illustrated in FIG. 10A, in an ideal situation, an airflow 1010 proceeds upward through fins 1004. FIG. 10B illustrates a channel 1019 formed between a first fin 1004A and a second fin 1004B. In this more realistic (as opposed to ideal) example, a volume of falling liquid 1020 may block the airflow 1010 from proceeding upward through the channel 1019, thereby interrupting the air flow 1010. For example, the liquid 1020 may bridge between first fin 1004A and second fin 1004B, and may remain there, for example, because of surface tension. This blocking of airflow does not occur in the heat exchanger of FIG. 1A, at least because the gaps between the fins 102A, 102B are larger than the gaps between the first fin 1004A and the second fin 1004B in FIG. 10B. For instance, the fins 102A and 102B are distanced such that, at the flow rates experienced in use, liquid will not bridge between the first fin 102A and the second fin 102B of FIG. 1B as it does between the first fin 1004A and the second fin 1004B of FIG. 10B.

Figure 2A:
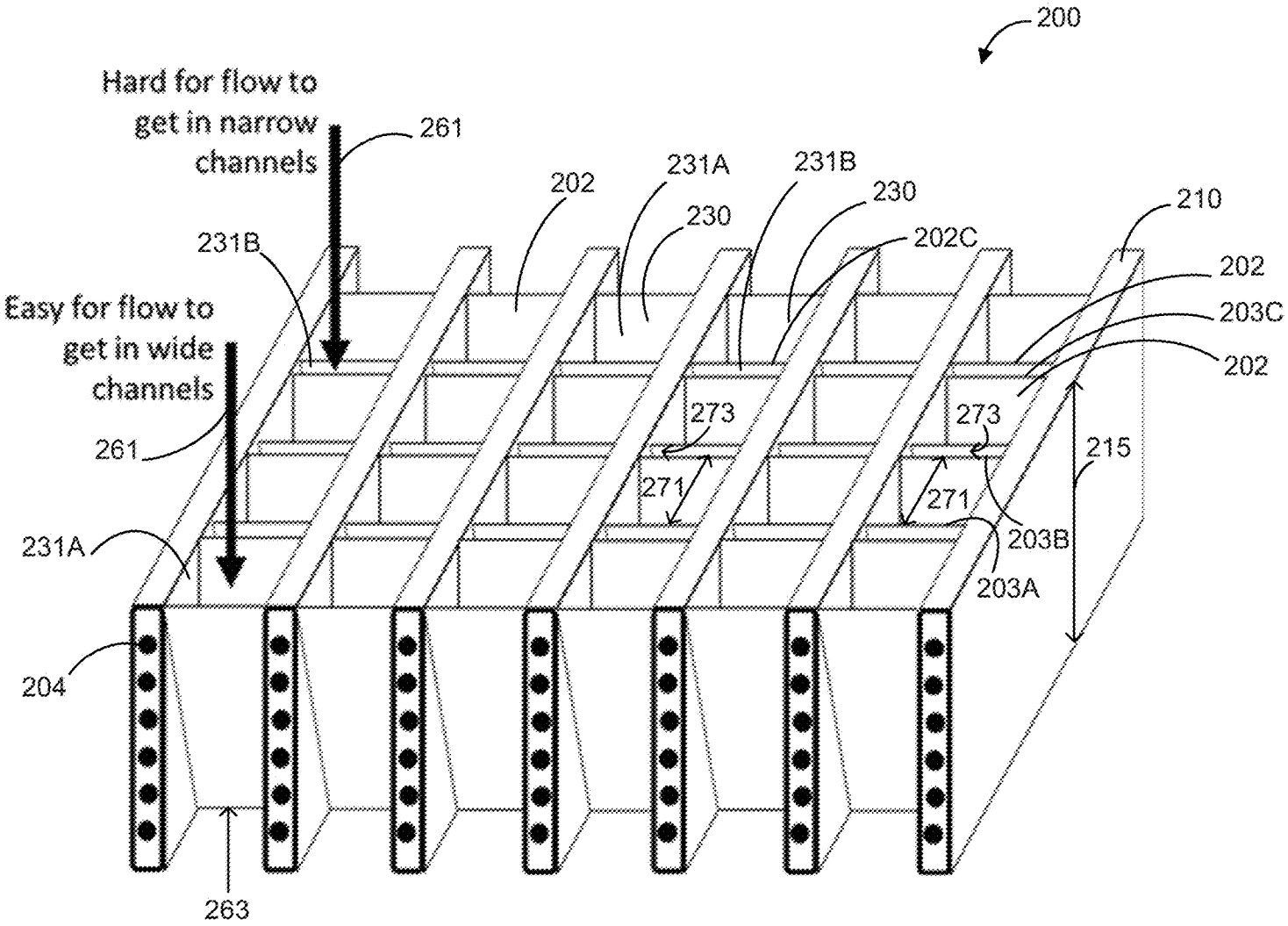
FIG. 2A illustrates a heat exchanger with angled fins, in accordance with one embodiment.
Figure 2B:
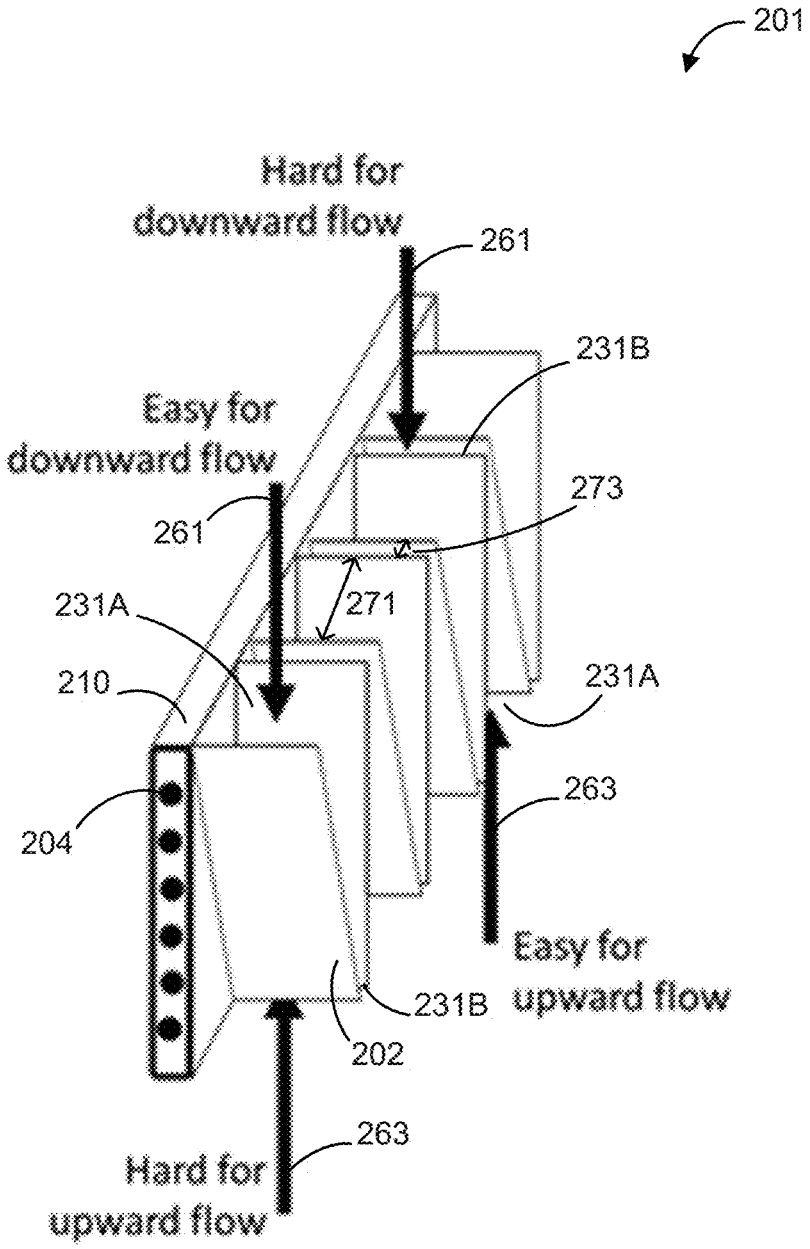
FIG. 2B illustrates a sectional view of the heat exchanger of FIG. 2A, in accordance with one embodiment.
Figure 2C:
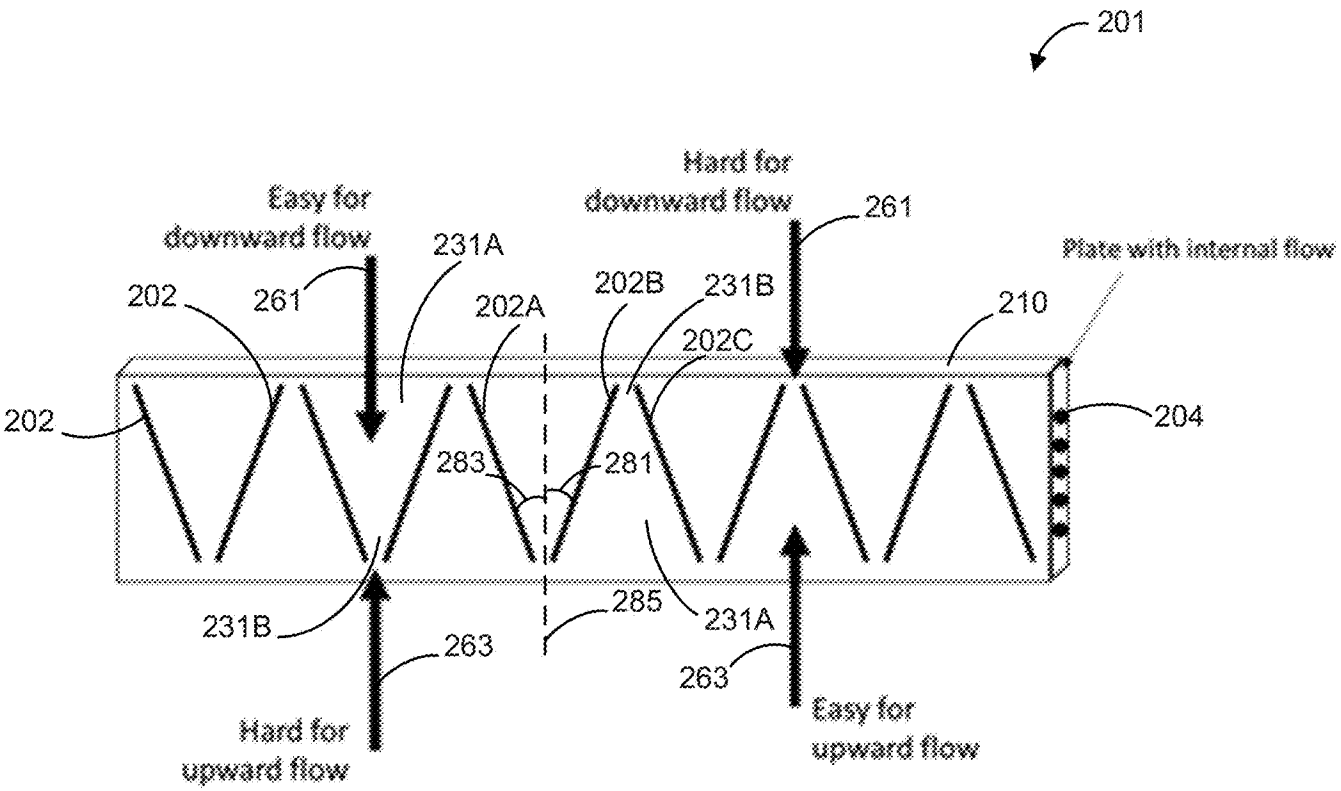
FIG. 2C illustrates a perspective view of the heat exchanger of FIG. 2A, in accordance with one embodiment.

FIGS. 2A, 2B, and 2C illustrate various views of a heat exchanger 200 that includes fins 202 that are angled toward each other along a width 215 of respective plates 210. The fins 202 and plates 210 are configured to form a plurality of channels 230, some of which include wider openings 231A and others which include narrower openings 231B from a first direction. Each channel 230 with a wider opening 231A from the first direction 261 has a narrower opening 231 when entering the channel from a second direction 263. Similarly, each channel 230 with a narrower opening 231B from the first direction has a wider opening 231A when entering the channel 230 from the second direction 263. The second direction may be opposite the first direction. A fin 202, such as fin 202C, may define a wall (e.g., sidewall) of a wider opening 231A on one side and a narrower opening 231B on the other side. In other words, a first surface of fin 202C defines a wall of wider opening 231A and a second surface of fin 202C may define a wall of narrower opening 231B.

In some examples, a fluid, such as a liquid (e.g., water, liquid desiccant), flows through the channels 230 from the first direction 261, while a second fluid, such as air, flows through the channels 230 from the second direction 263. The fluid flowing in the first direction may tend to enter a portion of the channels 230 that have wider openings 231A from the first direction 261, while the fluid flowing in the second direction 263 may tend to enter the portion of the channels 230 that have wider openings 231A from the second direction. In some examples, a third fluid, such as a refrigerant, flows in a perpendicular direction through micro-channels 204 within the plates 201. As a fluid, such as an air flow, proceeds through the channels 230, the refrigerant may cause heat to transfer from the air flow through a respective plate 210 to the refrigerant within the micro-channels 204.

To form the channels 230, the fins 202 are angled along the width 215 of corresponding plates 210. For instance, a first fin 203A and a second fin 203B may be angled toward each other such that they are a first distance 271 apart from each other at one end of the width of a plate 210, and they are a second distance 273 apart from each other at the opposed end of the width of the plate 201. The first distance 271 may be greater than the second distance 273. For example, by separating first and second fins 203A, 203B by the first distance 271 at one end of the width of a plate 201, and separating the same fins 203A, 203B by the second distance 273 at the opposite end of the width of the plate 201, the first fin 203A and the second fin 203B may form a wider opening 231A to a channel 230 from a first direction 261, and a narrower opening 231B to the same channel 230 from a second direction 263.

By orienting the fins 202 (e.g., metal fins 202) towards each other as described herein, heat exchanger 200 provides for the preferential flow of one liquid in one direction, and another fluid in the opposite direction, through the channels 230 defined by the fins 202 and plates 210. For instance, liquid flow in one direction would tend to not significantly block airflow in the opposite direction, because the liquid flow in a first direction (e.g., downward) would tend to preferentially choose flow paths into the channels 230 with wider entrance openings from the first direction (e.g., openings 231A), while airflows in a second direction (e.g., upward) would tend to preferentially choose flow paths into the channels 230 with wider entrance openings from the second direction (e.g., openings 231B).

In some examples, and referring to the orientation in FIGS. 2A, 2B, and 2C, desiccant is provided in a downward direction 261 through the channels 230. The desiccant is more likely to enter the wider openings 231A of the channels 230 than the narrower openings 231B of the channels 230 from the first direction 261. Because the narrower openings 231B from the first direction 261 correspond to channels 230 with wider openings 231A from the second direction 263, air flow from the second direction 263 (upward through the channels 230) is more likely to enter these channels 230.

FIG. 2B illustrates a single plate-fin assembly 201 of FIG. 2A with the right side plate removed to further illustrate the fins 202 configured to provide wider openings 231A at one end of a width of a plate 210, and corresponding narrower openings 231B at an opposite end of the width of the plate 210. FIG. 2C illustrates a section view of the single plate-fin assembly 201 of FIG. 2B.

FIG. 2C further illustrates fins 202A and 202B angled toward each other along centerline 285 that traverses along the width of plate 210. In this example, first fin 202A is positioned at a first angle 283 with respect to centerline 285, and second fin 202B is positioned at a second angle 281 with respect to the centerline 285. The second angle 281 may be equal to the first angle 283. For instance, second angle 281 and first angle 283 may each measure forty five degrees from the centerline 285. In some examples, each of the first angle 283 and the second angle 281 may measure anywhere in the range from five degrees to forty-five degrees, ten degrees to eighty degrees from the centerline, or from fifteen to sixty degrees, or from twenty to forty-five degrees, or from twenty to thirty-five degrees, or any combination thereof.

In some embodiments, an assembly includes a first plate 210, a second plate 210, and a plurality of fins 202 disposed between the first plate 210 and the second plate 210. The plurality of fins 202 include at least a first fin 202A, a second fin 202B, and a third fin 202. The first fin 202A and the second fin 202B define a first channel, and the second fin 202B and a third fin 202C define a second channel. A first distance between the first fin 202A and the second fin 202B at a first end of the first channel is wider (e.g., wider opening 231A) than a second distance between the first fin 202A and the second fin 202B at a second end of the first channel opposite the first end of the first channel (e.g., narrower opening 231B).

In some examples, the first channel is configured to direct a first fluid flow, and the second channel is configured to direct a second fluid flow in a second direction opposite the first direction. In some examples, the first plate and the second plate each include a plurality of micro-channels 204. In some examples, the plurality of micro-channels 204 are configured to direct a third fluid flow in a direction perpendicular to a direction of the first fluid flow and the second fluid flow. In some examples, a first distance between the second fin 202B and the third fin 202C at a first end of the second channel is narrower (narrower opening 231B) than a second distance between the second fin 202B and the third fin 202C at a second end of the second channel opposite the first end of the second channel (e.g., wider opening 231A).

Figure 3:
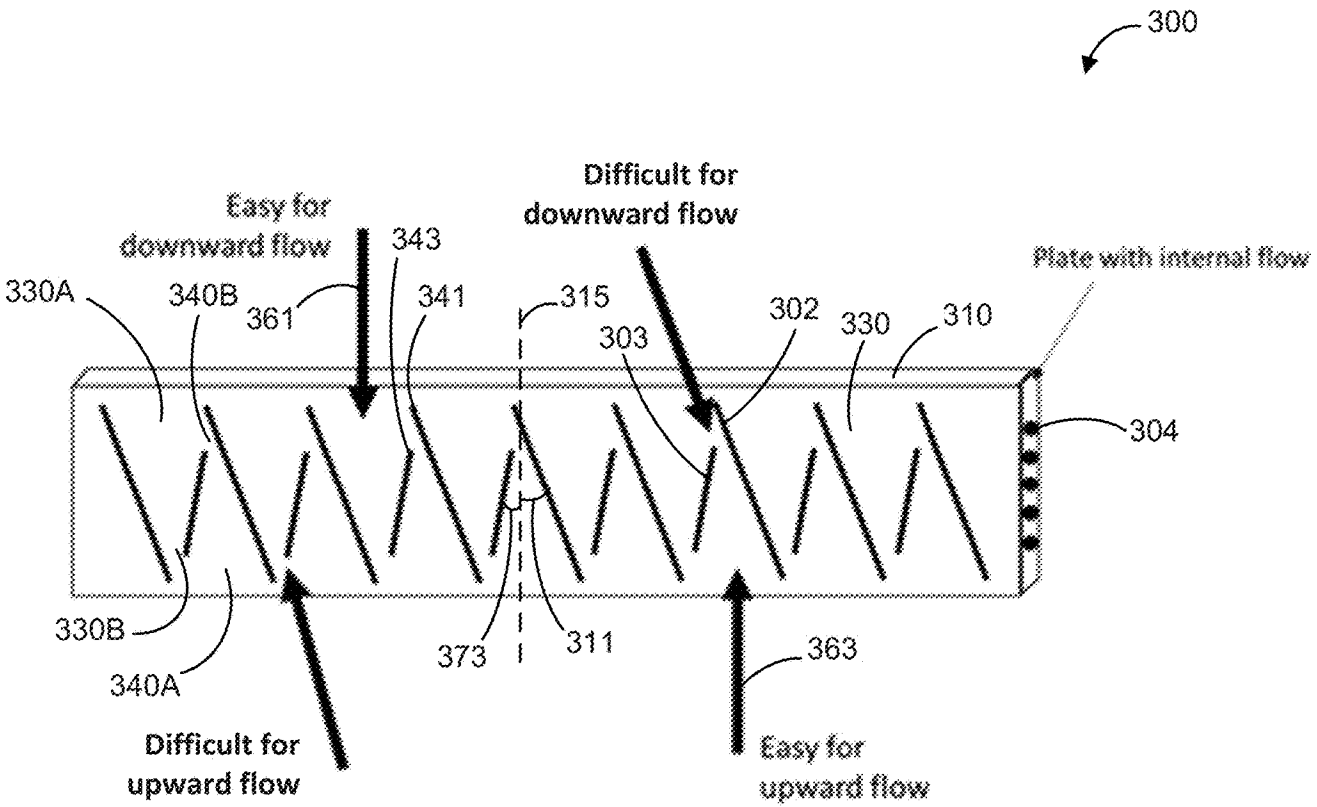
FIG. 3 illustrates a perspective view of another heat exchanger with angled fins, in accordance with one embodiment.

FIG. 3 illustrates a single plate/fin assembly 300 of an exemplary heat exchanger that includes a plate 310 with first fins 302 that extend above corresponding second fins 303. For instance, each first fin 302 may be of a first length, and each second fin 303 may be of a second length, where the first length is greater than the second length. In some examples, the first length may be the same as the second length, or less than the second length, with a first fin 302 still extending above a second fin 303. In some examples, the first length is in the range of 5% to 50%, inclusive, longer than the second length. The first fins 302, second fins 303, and inside surfaces of at least two plates 310 may form channels 330 through which fluid may flow. In some examples, the plates 310 include micro-channels 304 aligned generally perpendicular to the channels 330 to allow for fluid flow, such as refrigerant flow.

As show in FIG. 3, in some embodiment each first fin 302 may form a first angle 311 with a centerline 315 along a width of plate 310, and each second fin 303 may form a second angle 373 with the centerline 315. In some examples, the first angle 311 and the second angle 373 are different. In some examples, each first angle 311 and second angle 373 is between fifteen and eighty degrees. In some examples, the first angle 311 is greater than the second angle 373. In some examples, a top end 341 of each first fin 302 appears laterally in line with a top edge 342 of a respective second fin 303. The first fins 302, second fins 303, and inside surfaces of plates 310 form channels 320 thorough which fluid may flow. For instance, a fluid, such as water vapor or a liquid desiccant, may flow in a downward direction 361, while an airflow may flow in an upward direction 363. As will be understood, in any of the examples provided herein, the denser fluid can flow in the downward direction, while the less dense fluid can flow in the upward direction. Similarly, the micro-channels can be arranged generally horizontally.

As shown in FIG. 3, in some embodiments the fins 302 are arranged to prevent the downward flow of a fluid, such as a liquid, into a subset of the channels 330, such as the channels 330 with narrow openings 340B at the upper end. For instance, the channels 330 with narrow openings 340B at the upper end are at least partially blocked off from any downward flow by the overlapping fins 302. A channel 330 that includes a wider opening 330A on a flow entrance end of plate 310 in a downward direction 361 may include a narrower opening 330B on the flow exit end of channel 330. As such, flow in a downward direction 361 may more easily enter wider opening 330A than narrower opening 340B. Similarly, a channel 330 that includes a wider opening 340A on a flow entrance end of plate 310 in an upward direction 363 may include a narrower opening 340B on the flow exit end of plate 310. Thus, flow in an upward direction 363 may more easily enter wider opening 340A than narrower opening 330B.

Figure 4A:
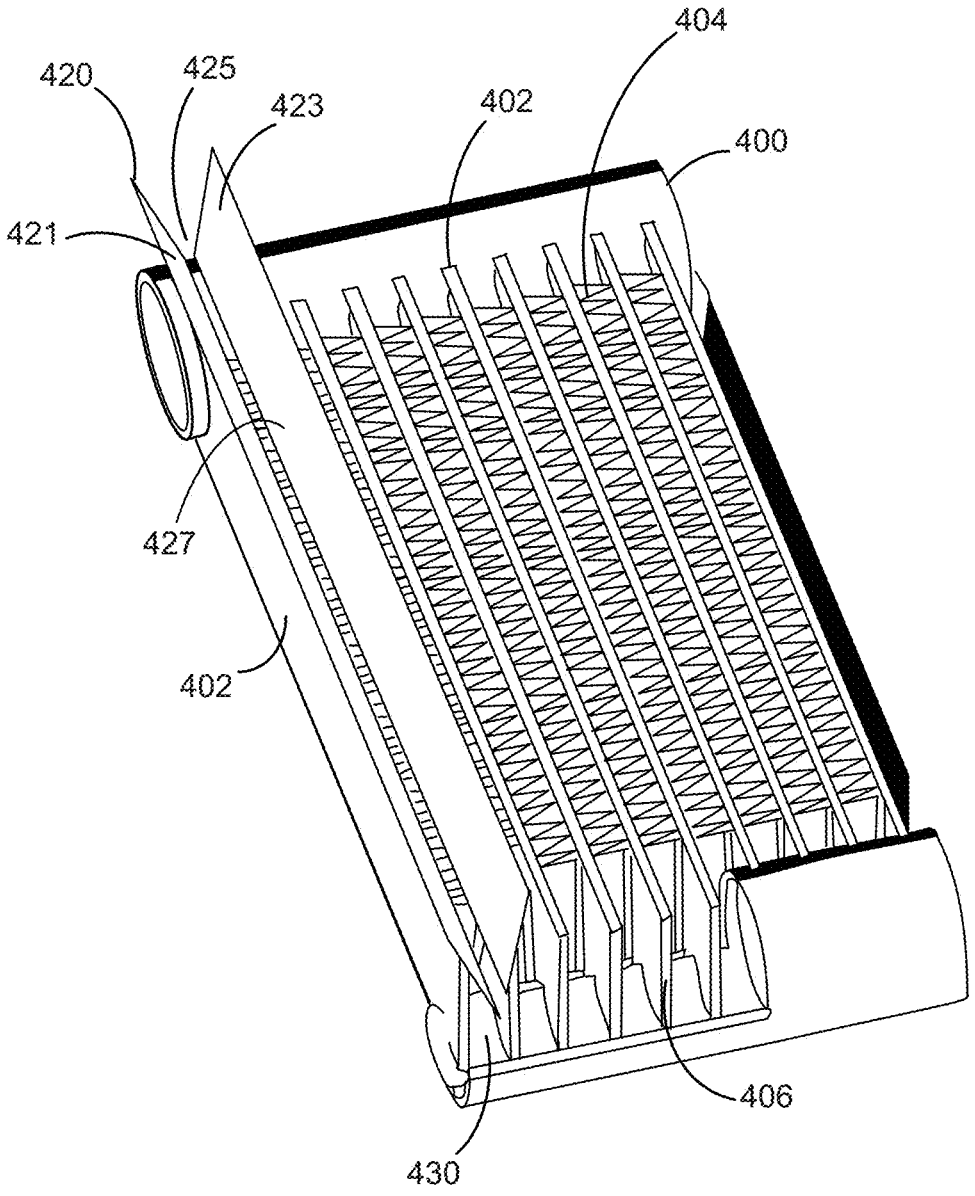
FIG. 4A illustrates a heat exchanger with a manifold, in accordance with one embodiment.
Figure 4B:
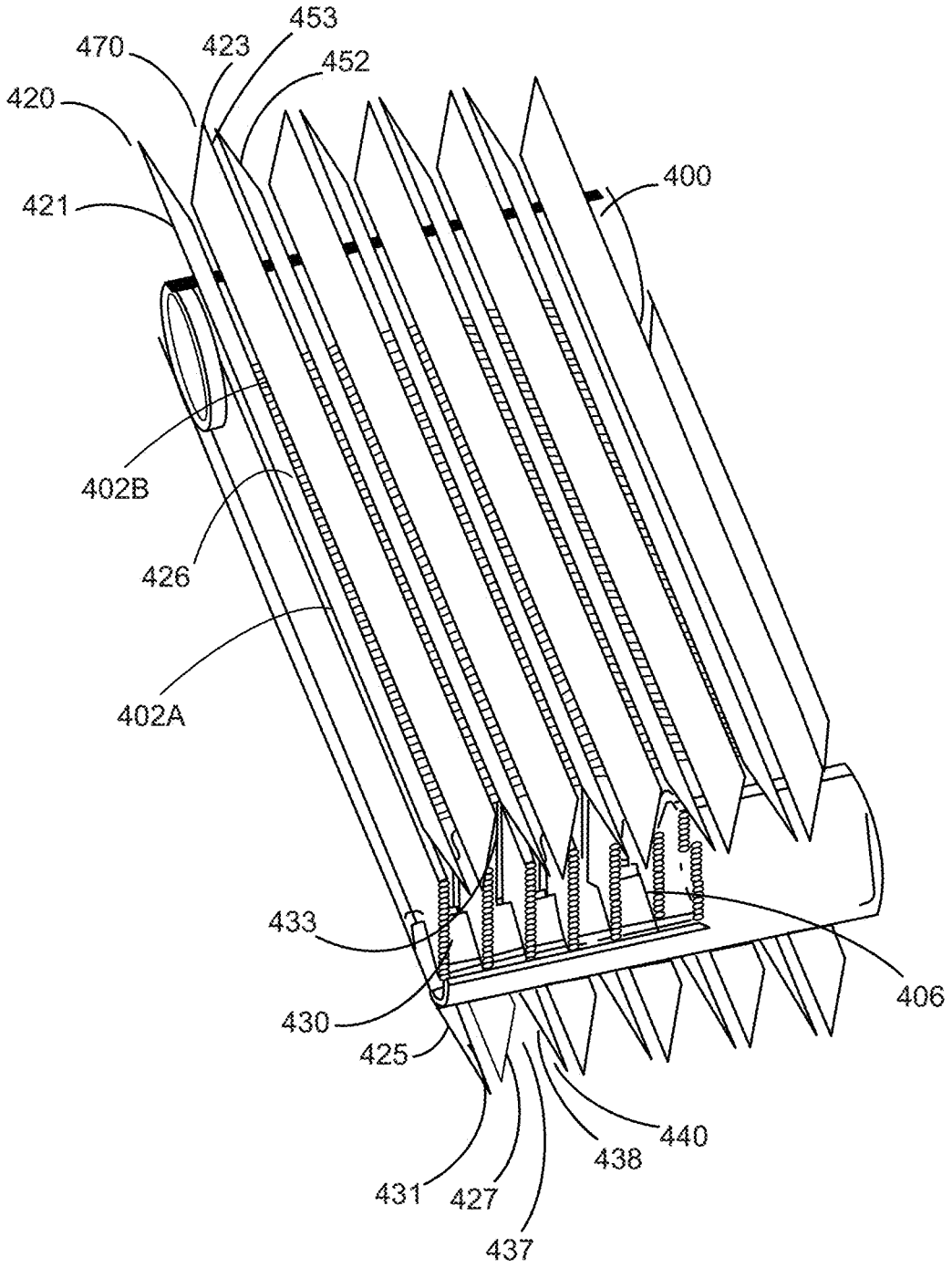
FIG. 4B illustrates a heat exchanger with multiple manifolds, in accordance with one embodiment.
Figure 4C:
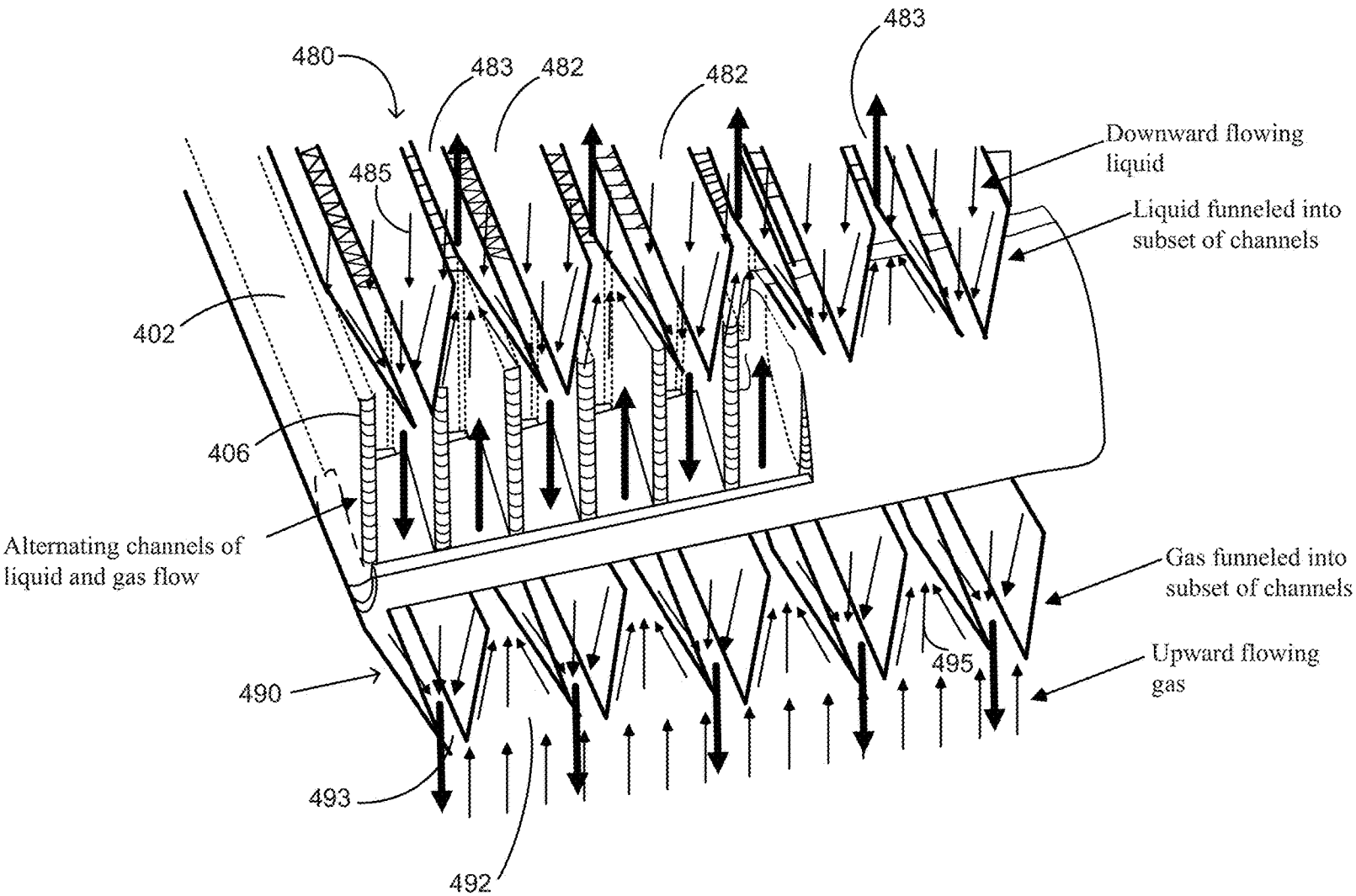
FIG. 4C illustrates a more detailed view of the heat exchanger with multiple manifolds of FIG. 4B, in accordance with one embodiment.

FIGS. 4A, 4B, and 4C illustrates a heat exchanger 400 that includes a plurality of fins 404 disposed between corresponding plates 402, where each plate may include one or more micro-channels 406. Referring to FIG. 4A, a manifold 420 is positioned above the fins 404 within fin row 430 to direct fluid flow, such as water vapor flow or air flow, onto the corresponding fin row 404. The manifold 402 may be coupled to one or more plates 402, and may include a first fin 421 and a second fin 423, where the first fin 421 and second fin 423 themselves form a channel 425 through which fluid may flow and be directed to the fin rows 404 beneath. In this example, the first fin 421 and the second fin 423 are configured to form a wider opening 427 over the corresponding fins 402. A manifold 420 can include a plurality of plates for directing a fluid entering the heat exchanger 420 into particular fins rows 404 and away from others. For example, the fluid flowing downward into the heat exchanger 420 can be directed into every other fin row 404.

FIG. 4B illustrates the heat exchanger 400 with a plurality of manifolds 420, one manifold on one side of (e.g., above) each row of fins 402, and one manifold on the other side of (e.g., beneath) each row of fins 402. For example, first fin 421 and second fin 423 are positioned over corresponding row of fins 402A and angled to form a gradually narrowing opening 426 for fluid flowing downward, and a third fin 425 and a fourth fin 427 are positioned beneath the same row of fins 402A and angled to from gradually narrowing opening 431. Thus, fluids flowing downward is directed into the desired row of fins 402A by the upper manifold and the fluid exiting the desired row of fins 402A exits through a narrow opening 431, so it can be easily collected.

Fourth fin 427 may form a manifold 440 with sixth fin 438 to form a wider opening 437 adjacent the narrower opening 431. Thus, fluids flowing upward can be directed to a row of fins 402B, in a similar manner to that described above with respect to fluids flowing downward through row of fins 402A. In addition, second fin 423 may form a manifold 470 with a fifth fin 452 to form a narrow opening 453 adjacent the wider opening 426. Manifold 470 may thus direct the upward flow though row of fins 402B thorough narrow opening 453. As such, the manifolds allow segregation of more than one fluid used in heat transfer. Because fluid flows from either side of the heat exchanger 400 are directed to alternate fin rows 430 (402A, 402B), the heat exchanger 400 with manifolds allows multiple fluids to participate in the heat transfer process, while reducing the impedance one fluid flow can cause to another fluid flow. For example, liquid desiccant can be regenerated by heating the liquid desiccant as it cascades down through rows of fins 402A, while heating air flows in alternating of fins 402B, and a refrigerant (heat transfer fluid) flows through the micro-channels in the plates 406.

FIG. 4C illustrates flows through wider and narrower channels of heat exchanger 400. In this example, a liquid (e.g., liquid desiccant) flows downward through the top manifolds 480, where a substantial amount (e.g., most) of the liquid flows through channels with wider openings 482. For instance, more of the liquid flows through channels with wider openings 482 than through channels with narrower openings 483, as indicated by the downward pointing arrows 485. The liquid continues flowing between fins disposed between corresponding plates 402, and then through the corresponding bottom manifolds 490. Each top manifold 480 with a wider opening 482 has a corresponding bottom manifold 490 with a narrow opening 493. Thus, liquid flowing through wider openings 482 of top manifolds 480 proceed through narrower openings 493 of bottom manifolds 490.

Similarly, a gas flows upward through the bottom manifolds 490, where a substantial amount of the gas flows through channels with wider openings 492. For instance, more of the gas flows through channels with wider openings 492 than through channels with narrower openings 493, as indicated by the upward pointing arrows 495. The gas continues flowing between fins disposed between corresponding plates 402, and then through the corresponding top manifolds 480. Each bottom manifold 490 with a wider opening 492 has a corresponding top manifold 480 with a narrow opening 483. Thus, gas flowing through wider openings 492 of bottom manifolds 490 proceed through narrower openings 483 of top manifolds 480.

As a result, heat exchanger 400 provides a heat exchange system that allows for multiple fluids to partake in the heat transfer process, where a substantial amount of one fluid is directed to a first set of channels, and a substantial amount of another fluid is directed to a second set of channels. In some examples, the fluids flow in directions opposite of each other. Further, the manifolds of heat exchanger 400 are configured to provide alternating channels of liquid and gas flow (e.g., a downward liquid flow, and an upward gas flow).

Figure 5A:
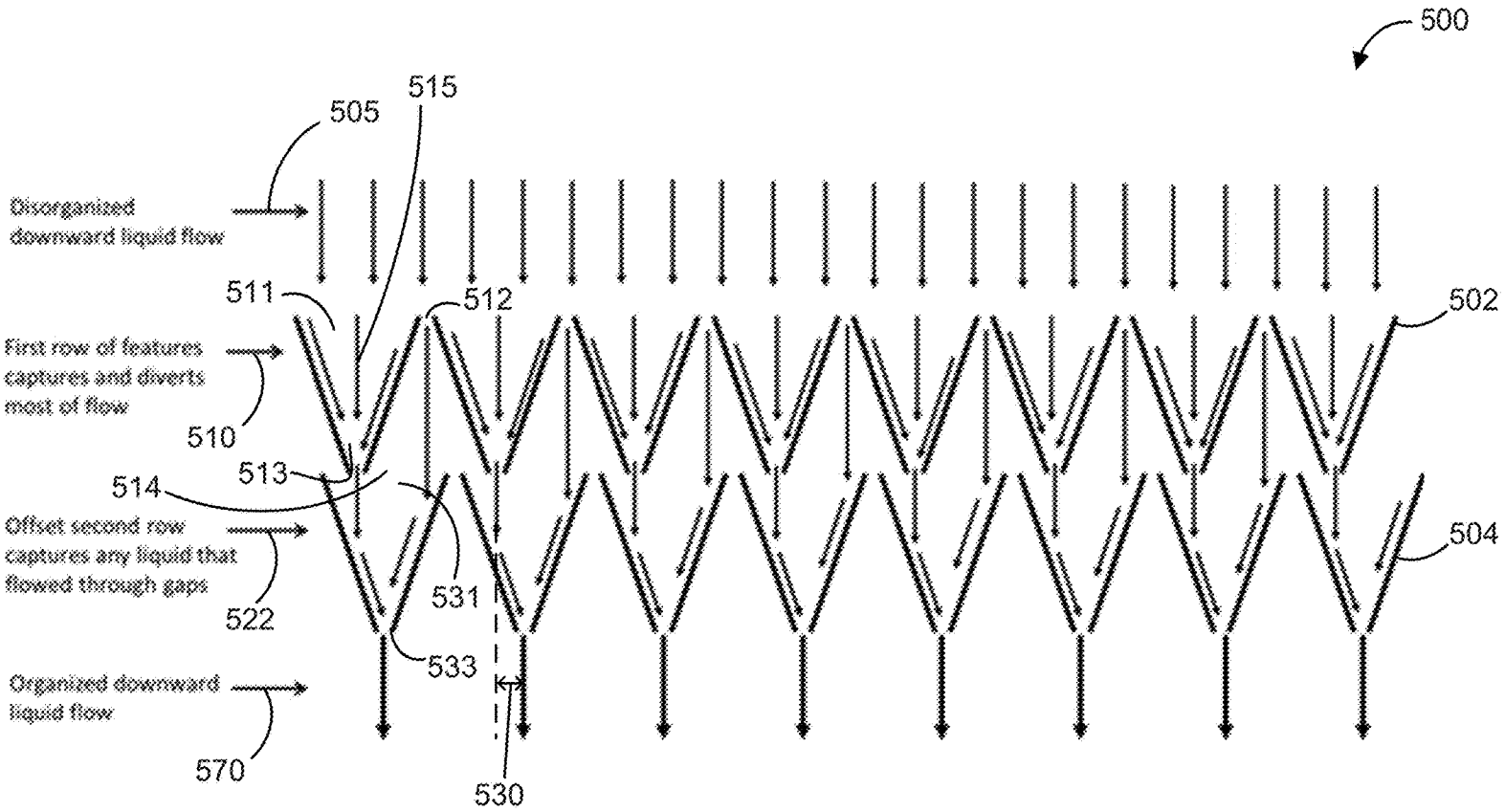
FIG. 5A illustrates multiple rows of manifolds in an offset configuration, in accordance with on embodiment.

In some examples, a heat exchanger may include multiple rows of manifolds to further ensure segregation of the counter-flowing fluids. For instance, FIG. 5A illustrates a manifold assembly 500 with multiple rows 510, 522 of manifolds 502, 504 in an offset configuration. The manifolds 502, 504 may be coupled to, for example, sidewalls of a heat exchange. A first flow, downward fluid flow 505, is provided into wider openings 511 and narrower openings 512 of a first row 510 of manifolds 502. The downward fluid flow 505 may be water, a desiccant, or any other suitable liquid. A substantial amount of the fluid flow 505 is diverted to the wider openings 511 compared to the narrower openings 512 of the first row 510 of manifolds 502, as indicated by the first row 515 arrows, at least because wider openings 511 are wider than narrower openings 512. In some examples, a length of each narrower opening 512 is a predetermined percentage of wider opening 511. For instance, the length of each narrower opening 512 may be in the range of 1% to 50% of the length of each wider opening 511. In some examples, the length of each narrower opening 512 may be in the range of 1% to 10%, 2% to 8%, 3% to 11%, or 5% to 15% of the length of each wider opening 511.

The fluid flow 505, after proceeding through the first row 510 of manifolds 502, encounters a second row 522 of manifolds 504. The second row 522 of manifolds 504 are offset from the first row 510 of manifolds 502 by a predetermined distance 530. The distance 530 may be a length such that fluid flow exiting from a narrow opening 513 of manifold 502, as well as a substantial amount of fluid exiting from a wider opening 514 of a manifold 502, is captured by a wider opening 531 of a second row 522 manifold 504. For instance, distance 530 may be 10% to 40% of a length of wider openings 511 of manifolds 502, where wider openings 531 of manifolds 504 is a length substantially the same, or the same, as a length of wider opening 511.

In some instances, the wider openings 511 of the manifolds 502 of the first row 510 are the same length as the wider openings 531 of the manifolds 504 of the second row 522. Similarly, in some instances, the narrower openings 513 of the manifolds 502 of the first row 510 are the same length as the narrower openings 533 of the manifolds 504 of the second row 522. By combining and offsetting multiple rows of manifolds, an organized downward liquid flow 570 may be provided. For instance, the downward liquid flow 570 may be provided to alternating fin rows of a heat exchanger, such as to fins 102 of heat exchanger 100, or any other suitable heat exchanger.

Figure 5B:
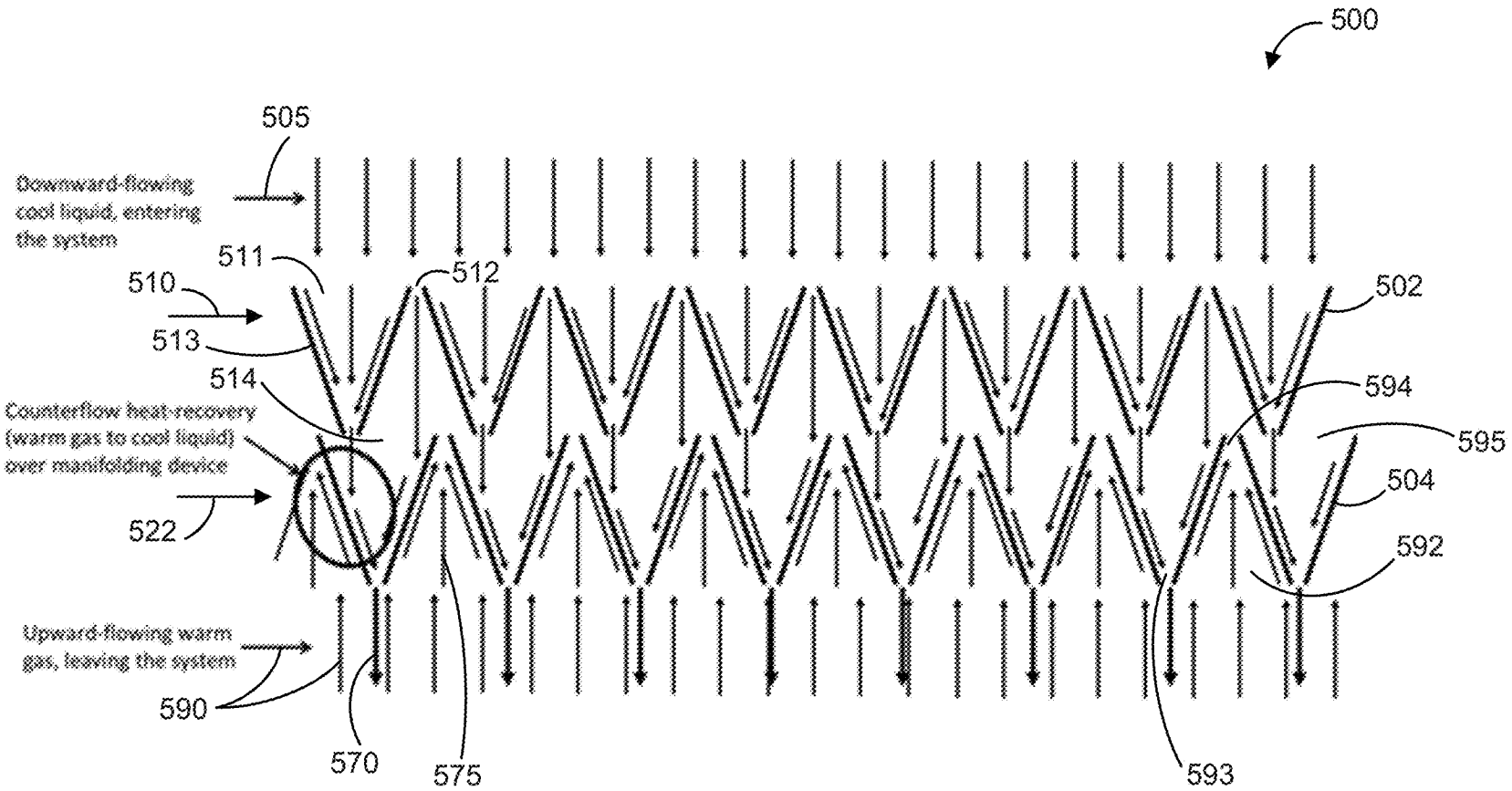
FIG. 5B illustrates another view of the multiple rows of manifolds of FIG. 5A, in accordance with one embodiment.

FIG. 5B illustrates the manifold assembly 500 of FIG. 5A, further illustrating a second flow, gas flow 590, in an upward direction towards the second row 533 of manifolds 504. A substantial amount of the gas flow 590 is diverted to the wider openings 592 compared to the narrower openings 593 of the second row 522 of manifolds 504, as indicated by the second row 575 arrows, at least because wider openings 592 are wider than narrower openings 593. In some examples, a length of each narrower opening 593 is substantially the same as the length of narrower openings 512 of the manifolds 502, and a length of each wider opening 592 is substantially the same as the length of wider openings 511 of the manifolds 502. The gas flow 590, after proceeding through the second row 522 of manifolds 504, encounters the first row 510 of manifolds 502.

As a result of the configuration of the first row 510 of manifolds 502 being offset from the second row 522 of manifolds 504, manifold assembly 500 facilitates two flows in opposite directions from each other, each flow substantially proceeding through alternating channels defined by the manifolds 502, 504. For instance, manifold assembly 500 causes a substantial amount of the fluid flow 505 to flow through the wide openings 511 of manifolds 502 compared to the narrower openings 512 of manifolds 502. Further, after passing through manifolds 502, the fluid flow is substantially directed to wide openings 595 of manifolds 504 compared to narrower openings 594 of manifolds 504. For example, most (e.g., more than 50%) if not all of the fluid flow 505 that passes through a wide channel 511 of manifolds 502 is directed to a corresponding wide channel 595 of manifolds 504. In addition, most of the fluid flow 505 that passes through a narrow channel 512 of manifolds 502 is directed to one of two corresponding wide channels 595 of manifolds 504, while some of the fluid flow 505 that passes through the narrow channel 512 may be directed to a corresponding narrow channel 594 of manifolds 504. As a result, a substantial amount of the fluid flow 505 is provided through narrower openings 593 of manifolds 504 as downward liquid flow 570.

The upward flowing gas flow 590, however, may substantially proceed through a different flow path. For instance, a substantial amount of the gas flow 590 proceeds through wider openings 592 of manifolds 504 compared to narrower openings 593 of manifolds 504. The gas flow 590 is then directed to a wider opening 514 of a corresponding manifold 502. Gas flow 590 proceeding through narrow openings 593 of manifolds 504 may be directed to one of two wider openings 514 of manifolds 502, while some gas flow 590 may proceed thorough a narrow opening 513 between the two wider openings 514. As such, most of the gas flow 590 exits the manifolds 502 of the first row 510 through wider openings 511 than compared to narrower openings 512.

Thus, for example, while fluid flow 505 substantially passes downward through wider openings 511 of manifolds 502, gas flow 590 substantially passes upward through narrower openings 512. Likewise, while fluid flow 505 substantially passes downward through wider openings 595 of manifolds 504, gas flow 590 substantially passes upward through narrower openings 594 of manifolds 504. Further, while fluid flow 505 substantially exits through narrower openings 593 of manifolds 504, gas flow 590 substantially enters upward through wider openings 592 of manifolds 504.

Figure 6A:
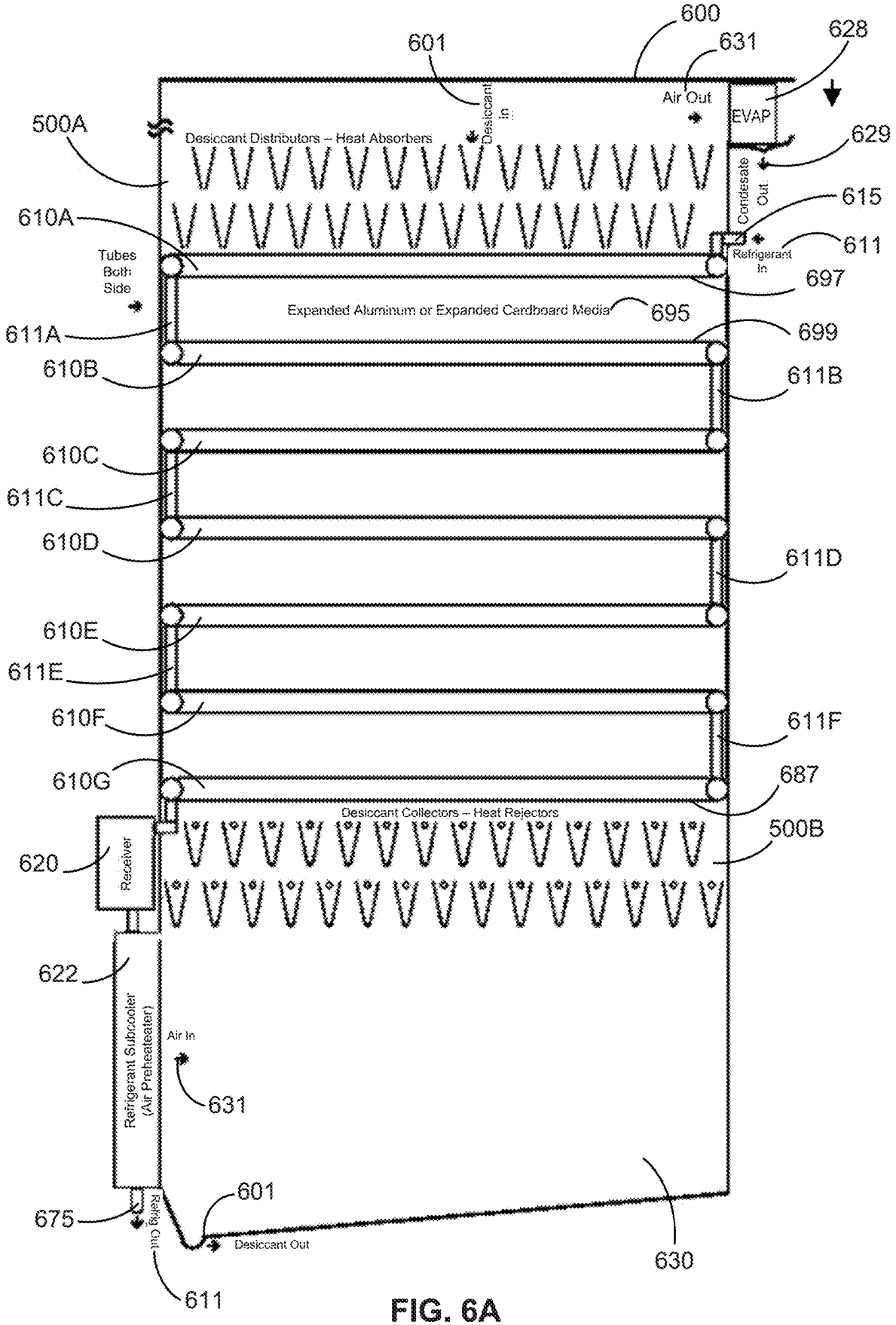
FIG. 6A illustrates another heat exchanger with multiple manifolds, in accordance with one embodiment.
Figure 6B:
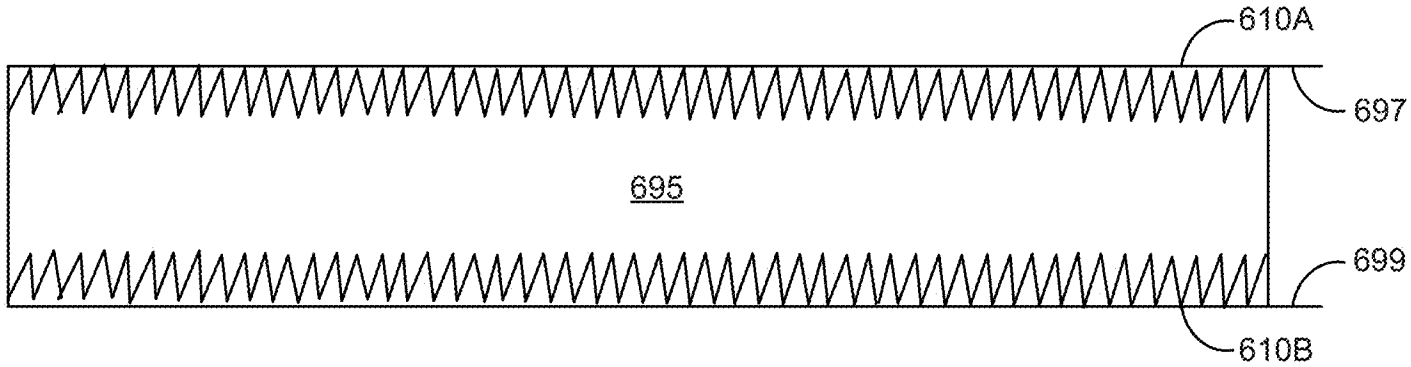
FIG. 6B illustrates exemplary portions of the heat exchanger of FIG. 6A, in accordance with one embodiment.

FIGS. 6A and 6B illustrate a use of the manifold assemblies 500 of FIG. 5, identified as manifold assembly 500A and manifold assembly 500B. As illustrated in FIG. 6A, manifold assembly 500A is configured as a desiccant distributor, and manifold assembly 500B is configured as a desiccant collector, which are adapted to distribute liquid desiccant over a heat exchanger system 600. Heat exchanger system 600 can be any two fluid heat exchanger, such as a regenerator.

In this example, a refrigerant 611 is provided to an input valve 615, which provides the refrigerant 611 to one or more micro-channels of first plate-fin assembly 610A. The refrigerant 611 proceeds through the micro-channels to a first tube 611A connecting the first plate-fin assembly 610A to a second plate-fin assembly 610B. Further, the refrigerant 611 proceeds through the first tube 611A and through micro-channels of the second plate-fin assembly 610B to reach a second tube 611B. Similarly, the refrigerant 611 proceeds through the second tube 611B connecting the second plate-fin assembly 610B to a third plate-fin assembly 610C, and through micro-channels of the third plate-fin assembly 610C to a third tube 611C.

The refrigerant 611 continues proceeding through the third tube 611C connecting the third plate-fin assembly 610C to a fourth plate-fin assembly 610D, and through micro-channels of the fourth plate-fin assembly 610D to a fourth tube 611D. Further, the refrigerant 611 proceeds through the fourth tube 611D connecting the fourth plate-fin assembly 610D to a fifth plate-fin assembly 610E, and through micro-channels of the fifth plate-fin assembly 610E to reach a fifth tube 611E.

The refrigerant 611 proceeds through the fifth tube 611E connecting the fifth plate-fin assembly 610E to a sixth plate-fin assembly 610F, and through micro-channels of the sixth plate-fin assembly 610F to a sixth tube 611F. The refrigerant 611 proceeds through the sixth tube 611F connecting the sixth plate-fin assembly 610F to a seventh plate-fin assembly 610G, and through micro-channels of the seventh plate-fin assembly 610G to a receiver 620. The receiver 620 provides the received refrigerant 611 to a refrigerant cooler 622, which cools the refrigerant. After cooling, the refrigerant 611 exits the refrigerant cooler 622 through an exit valve 675, and may be directed back to the input valve 615.

An air flow 631 provided (e.g., by a fan) onto manifold assembly 500B, which distributes the air flow 631 (e.g., as described with respect to FIGS. 5A, 5B) across the plate-fin assemblies 610G, 610F, 610E, 610D, 610C, 610B, 610A. The air flow 631 is heated by the refrigerant 611 as it passes across the plates. After passing through the plates, the air flow 631 may proceed thorough manifold assembly 500A, which may distribute the airflow (e.g., as described with respect to FIGS. 5A, 5B) to an evaporator 628. The evaporator 628 condensates any moisture in the air flow 631 and outputs any generated condensate 629.

A desiccant 601 is provided over manifold assembly 500A, which distributes the desiccant 601 (e.g., as described with respect to FIGS. 5A, 5B) over first plate 610A. The desiccant 601 may proceed across plate-fin assemblies 610A, 610B, 610C, 610D, 610E, 610F, 610G, and may be collected by manifold assembly 500B, which may distribute the collected desiccant 601 (e.g., as described with respect to FIGS. 5A, 5B) to a reservoir 630 that outputs the desiccant 601.

As such, heat exchanger 600 allows air flow 631 to proceed across plate-fin assemblies 610G, 610F, 610E, 610D, 610C, 610B, 610A in one direction (e.g., bottom to top), and liquid desiccant to proceed across plate-fin assemblies 610A, 610B, 610C, 610D, 610E, 610F, 610G in an opposite direction (e.g., top to bottom). Manifold assembly 500A distributes the desiccant 601 across the plate-fin assemblies 610A, 610B, 610C, 610D, 610E, 610F, 610G, and also distributes the air flow 631 (e.g., warm air flow) to the evaporator 628. Manifold assembly 500B directs the desiccant 601 from the plate-fin assemblies 610A, 610B, 610C, 610D, 610E, 610F, 610G to the reservoir 630, and also directs the airflow 631 across the plate-fin assemblies 610G, 610F, 610E, 610D, 610C, 610B, 610A.

In some examples, each plate-fin assembly 610A, 610B, 610C, 610D, 610E, 610F, 610G may include additional offset manifold assemblies to divert each distinct fluid to separate channels of the respective plate-fin assembly 610A, 610B, 610C, 610D, 610E, 610F, 610G or another plate-fin assembly 610A, 610B, 610C, 610D, 610E, 610F, 610G.

Thus, in this example, desiccant may flow down through channels formed by the fins of manifold assembly 500A, continuing across plate-fin assemblies 610A, 610B, 610C, 610D, 610E, 610F, 610G, and through channels formed by the fins of manifold assembly 500B. Air flow, however, my proceed in the opposite direction. For instance, airflow may proceed up through channels formed by the fins of manifold assembly 500B, across the plate-fin assemblies 610G, 610F, 610E, 610D, 610C, 610B, 610A, and through channels formed by the fins of manifold assembly 500A. As refrigerant 611 flows through micro-channels of the plate-fin assemblies 610A, 610B, 610C, 610D, 610E, 610F, 610G, the refrigerant 611 is cooled by the air flow. Further, as the desiccant flows downward and across plate-fin assemblies 610A, 610B, 610C, 610D, 610E, 610F, 610G, the desiccant may dehumidify the airflow flowing in the opposite direction.

Figure 6C:
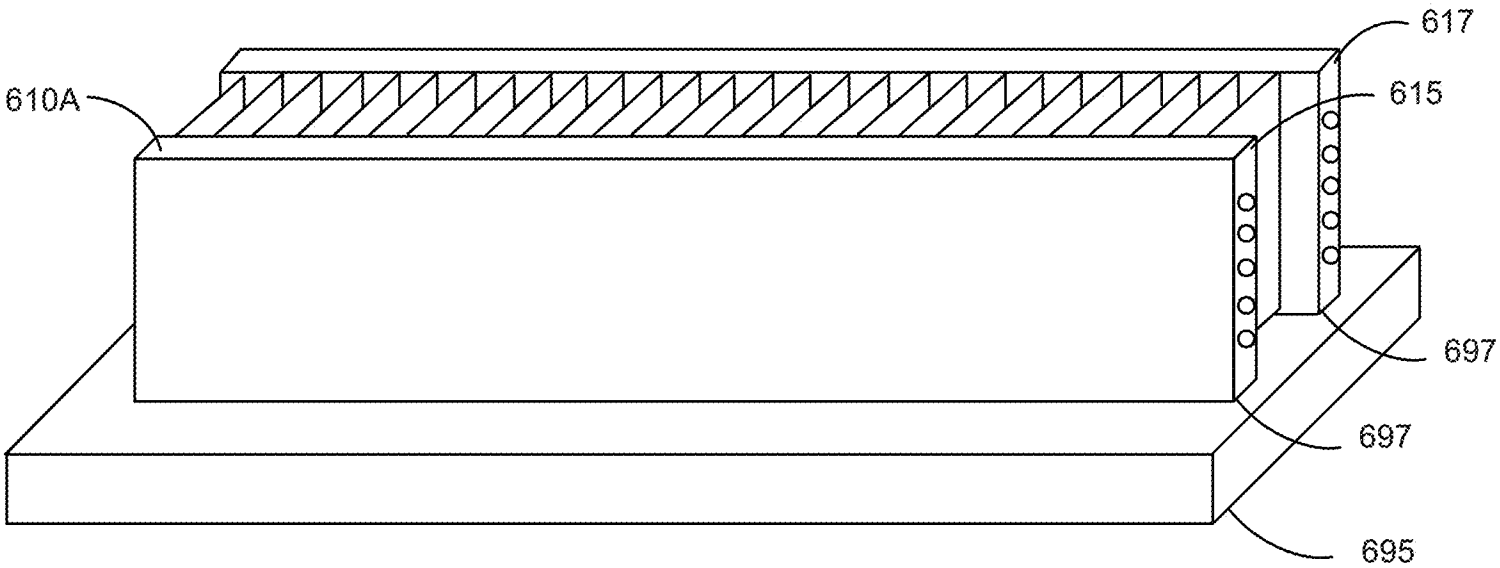
FIG. 6C illustrates exemplary portions of the heat exchanger of FIG. 6A, in accordance with one embodiment.

As illustrated in FIGS. 6A, 6B, and 6C, in some examples, a wicking media 695, such as aluminum or fibrous (e.g., cardboard) media, is positioned between plate-fin assemblies. For instance, the wicking media 695 may be in direct contact with a side of a plate of a plate-fin assembly that is opposite to a side of the plate with a plurality of fins. In some examples, the wicking media 695 is in direct contact with each of the plate-fin assemblies. For example, wicking media 695 may be in direct contact with a lower edge of a plate-fin assembly, such as the lower edge 697 of the first plate-fin assembly 610A. For instance, as illustrated in FIG. 6C, the wicking media 696 may be in direct contact with the lower edge 697 of at least one of the first plate 615 and the second plate 617 of the first plate-fin assembly 610A. In some examples, the wicking media 695 may, additionally or alternatively, be in contact with an upper edge of a plate-fin assembly, such as the upper edge 699 of the second plate-fin assembly 610B, as illustrated in FIGS. 6A and 6B. In some instances, liquid may tend to cling to the bottom edge of the heat exchanger and thus block airflow. To assist with this liquid accumulation, in some instances, wicking media 695 may be positioned to be in direct contact with a bottom of the heat exchanger system 600, such as along a lower edge 687 of the seventh plate-fin assembly 610G, as illustrated in FIG. 6A.

Figure 7:
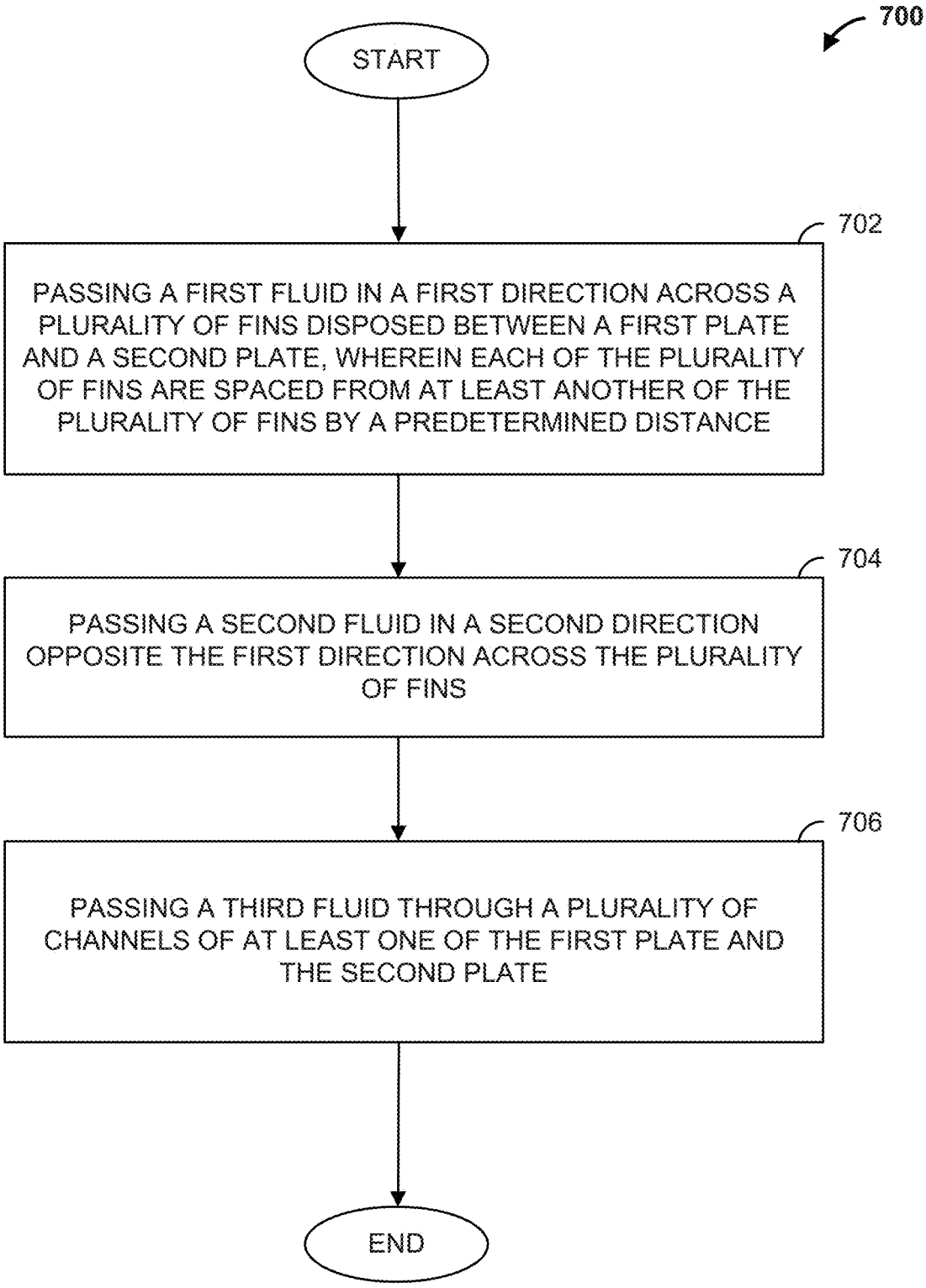
FIG. 7 illustrates a flowchart of an example method to divert fluids within a heat exchanger, in accordance with one embodiment.

FIG. 7 is a flowchart of a method to divert fluids within a heat exchanger, such as heat exchanger 100. Beginning at step 702, a first fluid is passed in a first direction across a plurality of fins disposed between a first plate and a second plate. Each of the plurality of fins are spaced from at least another of the plurality of fins by a predetermined distance. For instance, the first fluid may be a desiccant, and may be passed in a downward direction across a plurality of fins 102 disposed between plates 110A, 110B. Further, the plurality of fins 102 may be spaced apart such that there are anywhere between five and fifteen fins 102 per inch of a length of plates 110A, 110B. In some examples, the plurality of fins are spaced apart by a width large enough to enable counterflow of two fluids within a single fin channel.

Proceeding to step 704, a second fluid is passed in a second direction opposite the first direction across the plurality of fins. For example, air may be provided (e.g., by a fan) in an upward direction across the plurality of fins 102. At step 706, a third fluid is passed through a plurality of channels of at least one of the first plate and the second plate. For instance, a refrigerant may be passed through micro-channels of at least one of plates 110A, 110B. The refrigerant may cool the air moving upward across the plurality of fins 102.

Figure 8:
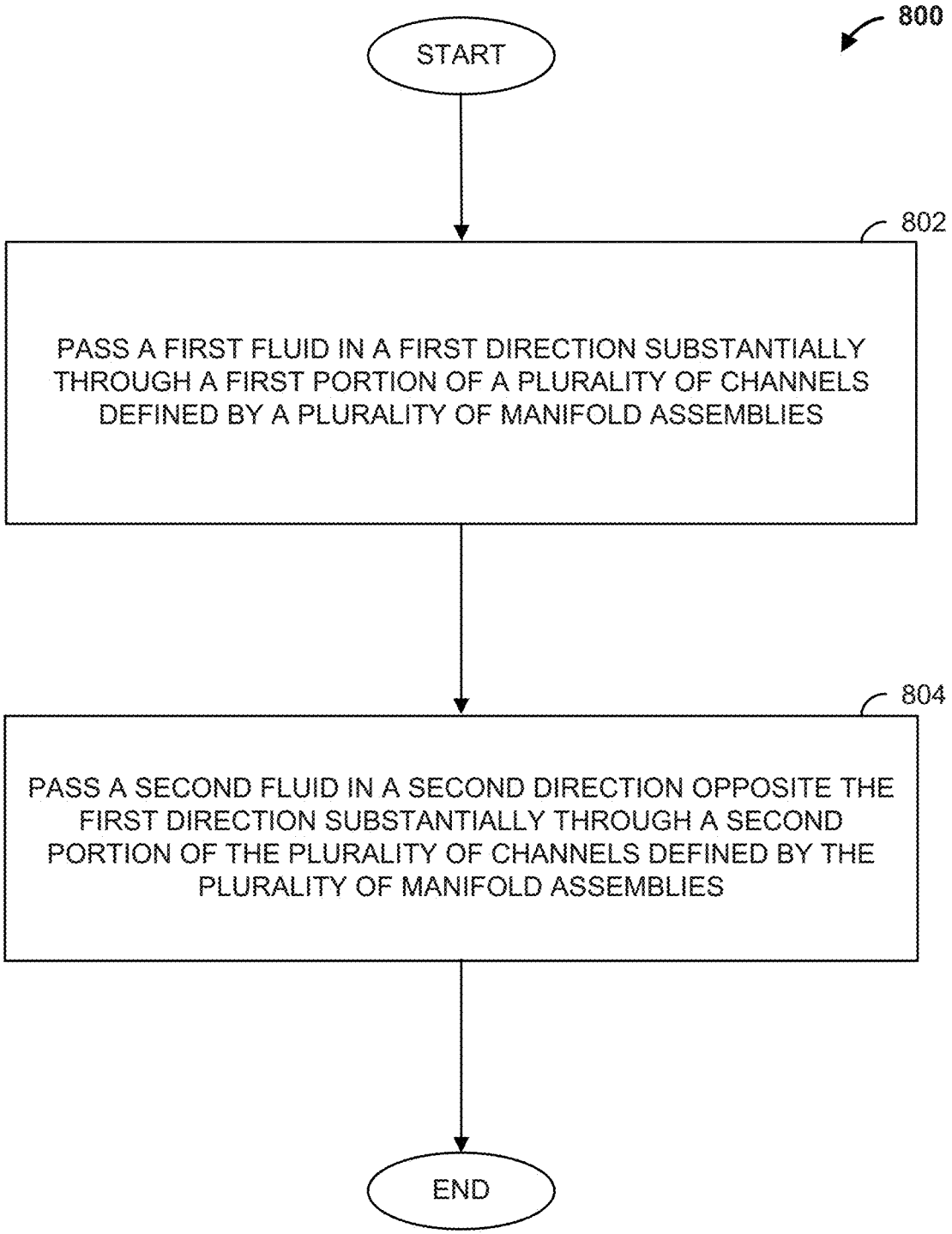
FIG. 8 illustrates a flowchart of another example method to divert fluids within a heat exchanger, in accordance with one embodiment.

FIG. 8 is a flowchart of another method to divert fluids within a heat exchanger, such as heat exchanger 400. Beginning at step 802, a first fluid is passed in a first direction substantially through a first portion of a plurality of channels defined by a plurality of manifold assemblies. For example, the first fluid may be a desiccant, and may proceed downward through wider openings 511 and out narrower openings 513 defined by manifolds 502 of manifold assembly 500.

At step 804, a second fluid is passed in a second direction opposite the first direction substantially through a second portion of the plurality of channels defined by the plurality of manifold assemblies. For instance, the second fluid may be forced air, and may proceed upward through wider openings 514 and out narrower openings 512 defined by the manifolds 502 of the manifold assembly 500.

Figure 9:
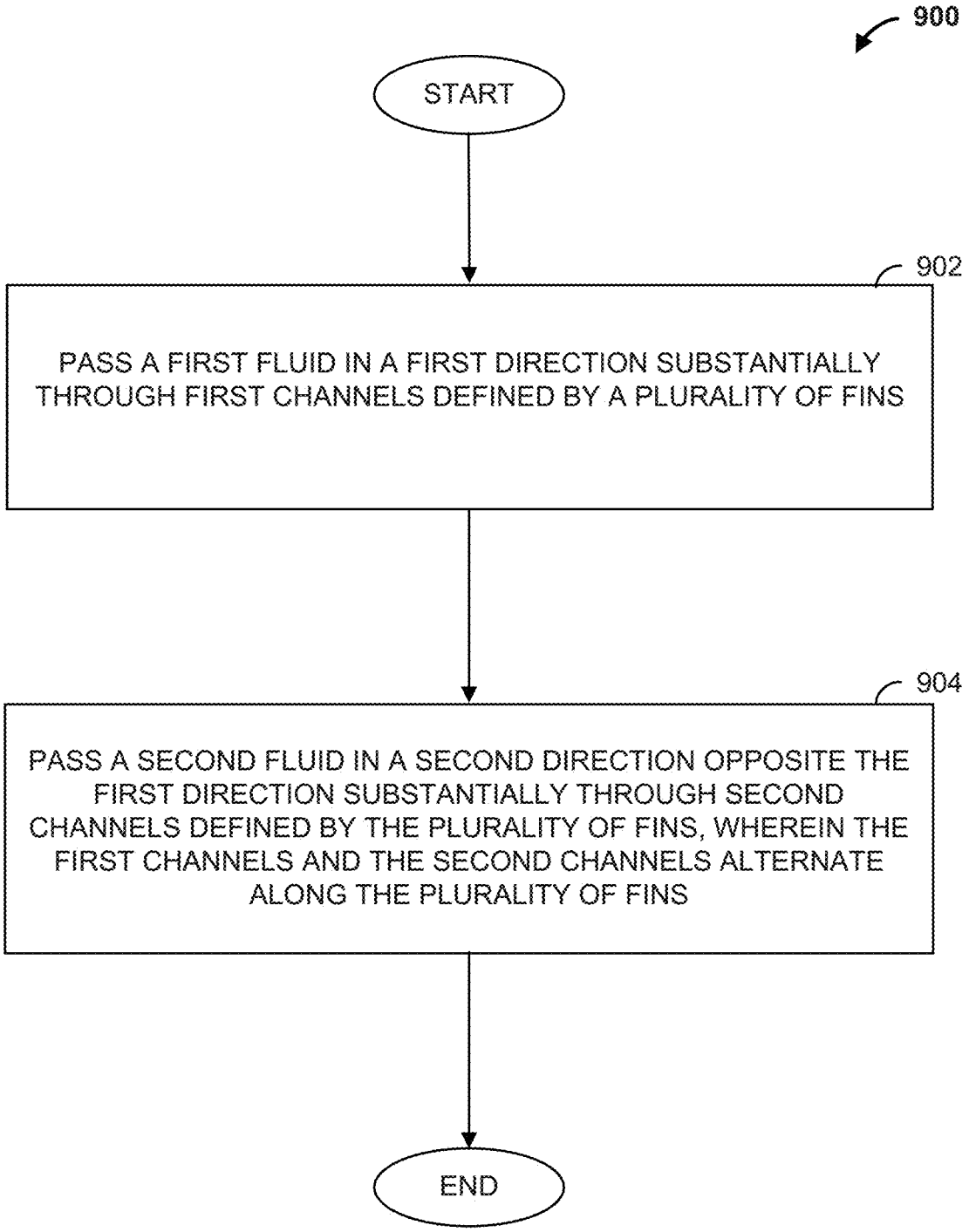
FIG. 9 illustrates a flowchart of an example method by a plate-fin assembly to divert fluids.

FIG. 9 is a flowchart of an example method to divert fluids by an assembly, such as assembly 300. Beginning at step 902, a first fluid is passed in a first direction substantially through first channels defined by a plurality of fins. For example, the first fluid may be a desiccant, and may proceed downward through channel 330A defined by first fins 302 and second fins 303.

At step 904, a second fluid is passed in a second direction opposite the first direction substantially through second channels defined by the plurality of fins. The first channels and the second channels alternate along the plurality of fins. For instance, the second fluid may be forced air, and may proceed upward through wider openings 340A, where channels 330A and 340A alternate along the first fins 302 and second fins 303.

The various embodiments described above are provided by way of illustration only and should not be construed to limit the claims attached hereto. Those skilled in the art will readily recognize various modifications and changes that may be made without following the example embodiments and applications illustrated and described herein, and without departing from the spirit and scope of the following claims.

What is claimed is:

1. An assembly comprising:

a first plate;

a second plate; and a plurality of fins disposed between the first plate and the second plate, wherein the plurality of fins comprise at least a first fin, a second fin, and a third fin, wherein the first fin and the second fin define a first channel, and the second fin and the third fin define a second channel, and wherein a first distance between the first fin and the second fin at a first end of the first channel is wider than a second distance between the first fin and the second fin at a second end of the first channel opposite the first end of the first channel, and wherein the first channel is configured to direct a first fluid flow, and the second channel is configured to direct a second fluid flow in a second direction opposite the first direction.

2. The assembly of claim 1, wherein the first plate and the second plate each comprise a plurality of micro-channels.

3. The assembly of claim 2, wherein the plurality of micro-channels are configured to direct a third fluid flow in a direction perpendicular to a direction of the first fluid flow and the second fluid flow.

4. The assembly of claim 1, where the second fin extends over the first fin.

5. The assembly of claim 1, wherein a length of the second fin is greater than a length of the first fin.

6. The assembly of claim 1, wherein a first distance between the second fin and the third fin at a first end of the second channel is narrower than a second distance between the second fin and the third fin at a second end of the second channel opposite the first end of the second channel.

7. The assembly of claim 1, comprising wicking media positioned in direct contact with a lower edge of at least one of the first plate or the second plate, claims in the application.

* * * * *